US011127359B2

(12) United States Patent
Yuan et al.

(10) Patent No.: US 11,127,359 B2
(45) Date of Patent: Sep. 21, 2021

(54) DISPLAY PANEL, METHOD FOR DRIVING THE SAME AND DISPLAY DEVICE

(71) Applicants: Hefei BOE Joint Technology Co., Ltd., Anhui (CN); BOE Technology Group Co., Ltd., Beijing (CN)

(72) Inventors: Can Yuan, Beijing (CN); Yongqian Li, Beijing (CN); Zhidong Yuan, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/081,384

(22) Filed: Oct. 27, 2020

(65) Prior Publication Data

US 2021/0125568 A1 Apr. 29, 2021

(30) Foreign Application Priority Data

Oct. 28, 2019 (CN) ..... 201911032028.2

(51) Int. Cl.
*G09G 3/3291* (2016.01)

(52) U.S. Cl.
CPC ... *G09G 3/3291* (2013.01); *G09G 2300/0426* (2013.01); *G09G 2310/027* (2013.01); *G09G 2310/0286* (2013.01); *G09G 2310/08* (2013.01)

(58) Field of Classification Search
CPC ..... G09G 3/3291; G09G 2300/0426; G09G 2310/027; G09G 2310/0286; G09G 2310/08; G09G 3/3266; G09G 3/3208
See application file for complete search history.

(56) References Cited

U.S. PATENT DOCUMENTS 9,466,240 B2 * 10/2016 Jaffari ..... G09G 3/3258
10,319,307 B2 * 6/2019 Chaji ..... G09G 3/3291
(Continued)

FOREIGN PATENT DOCUMENTS

CN 107068065 A 8/2017
CN 109166527 A 1/2019
(Continued)

OTHER PUBLICATIONS

First Office Action dated Sep. 1, 2020 corresponding to Chinese application No. 201911032028.2.
(Continued)

*Primary Examiner* — Andrew Sasinowski
(74) *Attorney, Agent, or Firm* — Nath, Goldberg & Meyer; Joshua B. Goldberg

(57) ABSTRACT

The present disclosure provides a display panel, a method thereof and a display device. The display panel includes a gate line group, a gate driving circuit, and a sub-pixel unit group. The sub-pixel unit group includes N rows of sub-pixel units, the gate line group includes (N+1) gate lines. The sub-pixel unit includes a light emitting unit, a pixel driving circuit, and a sensing circuit. The gate driving circuit includes output terminals, and is configured to sequentially output gate scanning signals through the output terminals. Each gate line is coupled to one corresponding output terminal. In the sub-pixel unit group, the pixel driving circuit in a sub-pixel unit in an n-th row is coupled to an n-th gate line; and the sensing circuit in the sub-pixel unit in the n-th row is coupled to a (n+1)-th gate line, where 1≤n≤N, and n is an integer.

20 Claims, 12 Drawing Sheets

(56) References Cited

U.S. PATENT DOCUMENTS

| | | | | |
|---|---|---|---|---|
| 2018/0047335 | A1* | 2/2018 | Hwang | G09G 3/3266 |
| 2018/0096645 | A1* | 4/2018 | Lee | G09G 3/20 |
| 2018/0337682 | A1* | 11/2018 | Takasugi | G09G 3/3241 |

FOREIGN PATENT DOCUMENTS

| | | | |
|---|---|---|---|
| CN | 109166529 | A | 1/2019 |
| CN | 109742134 | A | 5/2019 |
| KR | 20170079330 | A | 7/2017 |

OTHER PUBLICATIONS

Second Office Action dated Mar. 3, 2021 corresponding to Chinese application No. 201911032028.2.

* cited by examiner

DISPLAY PANEL, METHOD FOR DRIVING THE SAME AND DISPLAY DEVICE

CROSS REFERENCE TO RELATED APPLICATION

The present application claims priority to Chinese patent application No. 201911032028.2, filed on Oct. 28, 2019 to the Chinese Intellectual Property Office, the entire contents of which are incorporated herein by reference.

TECHNICAL FIELD

Embodiments of the present disclosure relate to the field of display technology, and in particular relate to a display panel, a method for driving the same and a display device.

BACKGROUND

In the display field, especially in the OLED (Organic Light-Emitting Diode) display field, with the rapid development of OLED display products, people have higher and higher requirements on performance of the OLED display products, especially high resolution and high quality OLED display products.

SUMMARY

In a first aspect, an embodiment of the present disclosure provides a display panel, including a gate line group, a gate driving circuit, and a sub-pixel unit group, wherein the sub-pixel unit group includes N rows of sub-pixel units, the gate line group includes (N+1) gate lines, where N is an integer greater than or equal to 2;

the sub-pixel unit includes a light emitting unit, a pixel driving circuit configured to drive the light emitting unit to emit light, and a sensing circuit configured to sense the pixel driving circuit;

the gate driving circuit includes a plurality of output terminals, and is configured to sequentially output gate scanning signals through the plurality of output terminals, each gate line is coupled to one corresponding output terminal of the gate driving circuit; and in the sub-pixel unit group, the pixel driving circuit in a sub-pixel unit in an n-th row is coupled to an n-th gate line in the gate line group; and the sensing circuit in the sub-pixel unit in the n-th row is coupled to a (n+1)-th gate line in the gate line group, where $1 \leq n \leq N$, and n is an integer.

In some embodiments, the display panel includes a plurality of gate lines and a plurality of rows of sub-pixel units, the plurality of gate lines are divided into a plurality of gate line groups, the plurality of rows of sub-pixel units are divided into a plurality of sub-pixel unit groups, and the plurality of gate line groups are in one-to-one correspondence with the plurality of sub-pixel unit groups.

In some embodiments, the display panel includes a first sub-pixel unit group and a second sub-pixel unit group directly adjacent to each other, a first sub-pixel unit from the first sub-pixel unit group and a second sub-pixel unit from the second sub-pixel unit group are directly adjacent to each other, and the first sub-pixel unit and the second sub-pixel unit do not share a same gate line.

In some embodiments, the pixel driving circuit includes a data writing circuit, a storage circuit and a driving circuit; the data writing circuit, the storage circuit, and the driving circuit are all coupled to a first node, and the driving circuit, the storage circuit, the sensing circuit, and the light emitting unit are all coupled to a second node;

the data writing circuit is further coupled to a corresponding first gate line and a corresponding data line, and configured to receive a gate scanning signal provided by the corresponding first gate line and write a data signal provided by the corresponding data line into the first node in response to a control of the gate scanning signal provided by the corresponding first gate line;

the driving circuit is configured to, in response to a control of a signal in an active level state at the first node, output a driving current to the second node to drive the light emitting unit to emit light;

the sensing circuit is further coupled to a corresponding sensing signal line and a corresponding second gate line, and configured to receive a gate scanning signal provided by the corresponding second gate line, and in response to a control of the gate scanning signal provided by the corresponding second gate line, write an initial signal provided by the corresponding sensing signal line into the second node or provide a sensing voltage signal sensed from the second node to the corresponding sensing signal line; and the storage circuit is configured to store the data signal written into the first node and the initial signal written into the second node.

In some embodiments, the data writing circuit includes a scan transistor having a first electrode coupled to the corresponding data line, a second electrode coupled to the first node, and a control electrode coupled to the corresponding first gate line.

In some embodiments, the driving circuit includes a driving transistor having a first electrode coupled to a first power supply terminal, a second electrode coupled to the second node, and a control electrode coupled to the first node.

In some embodiments, the sensing circuit includes a sensing transistor having a first electrode coupled to the corresponding sensing signal line, a second electrode coupled to the second node, and a control electrode coupled to the corresponding second gate line.

In some embodiments, the storage circuit includes a storage capacitor having a first terminal coupled to the first node and a second terminal coupled to the second node.

In some embodiments, the sensing circuits in every m columns of sub-pixel units are coupled to one sensing signal line, where $m \geq 2$.

In some embodiments, the display panel further includes an analog-to-digital conversion circuit and an initial signal source, each sensing signal line is coupled to the analog-to-digital conversion circuit through a first switch and coupled to the initial signal source through a second switch.

In some embodiments, the gate driving circuit includes a gate driving sub-circuit including a plurality of cascaded shift register units, each of which has at least one output terminal, and each output terminal is coupled to one corresponding gate line in the gate line group, each of plurality of cascaded shift register units includes an input circuit, a reset circuit and an output circuit, the input circuit is coupled to a signal input terminal, a first control terminal and a pull-up node, and is configured to write an input signal provided by the signal input terminal into the pull-up node in response to a control of a first control signal in an active level state provided by the first control terminal, the output circuit is coupled to the pull-up node, a first clock signal terminal, and a first output terminal, and is configured to transmit a first clock signal provided by the first clock signal terminal to the first output terminal in response to a control of a potential at the pull-up node, and the reset circuit is coupled to the pull-up node, a second control terminal and a second power supply terminal, and is configured to write a power supply signal provided by the second power supply terminal into the pull-up node in response to a control of a second control signal in an active level state provided by the second control terminal.

In some embodiments, the input circuit includes a first transistor having a first electrode coupled to the signal input terminal, a second electrode coupled to the pull-up node, and a control electrode coupled to the first control terminal;

the reset circuit includes a second transistor having a first electrode coupled to the second power supply terminal, a second electrode coupled to the pull-up node, and a control electrode coupled to the second control terminal; and the output circuit includes a capacitor and a third transistor, a first electrode of the third transistor is coupled to the first clock signal terminal, a second electrode of the third transistor is coupled to the first output terminal, and a control electrode of the third transistor is coupled to the pull-up node; and a first terminal of the capacitor is coupled to the pull-up node, and a second terminal of the capacitor is coupled to the second electrode of the third transistor.

In some embodiments, the gate driving sub-circuit includes (N+1) cascaded shift register units, each of which has a same circuit structure.

In some embodiments, the gate driving sub-circuit includes N cascaded shift register units, the output circuit in an N-th stage of shift register unit is a first output circuit, and the N-th stage of shift register unit further includes a second output circuit, the second output circuit is coupled to the pull-up node, a second clock signal terminal and a second output terminal, and is configured to transmit a second clock signal provided by the second clock signal terminal to the second output terminal in response to the control of the potential at the pull-up node.

In some embodiments, the second output circuit includes a fourth transistor having a first electrode coupled to the second clock signal terminal, a second electrode coupled to the second output terminal, and a control electrode coupled to the pull-up node.

In some embodiments, a first stage of shift register unit in the gate driving sub-circuit further includes a cascade circuit coupled to the pull-up node, a third clock signal terminal and a carry signal terminal and configured to transmit a third clock signal provided by the third clock signal terminal as a carry signal to the carry signal terminal in response to the control of the potential at the pull-up node, and the cascade circuit includes a fifth transistor having a first electrode coupled to the third clock signal terminal, a second electrode coupled to the carry signal terminal, and a control electrode coupled to the pull-up node.

In a second aspect, an embodiment of the present disclosure provides a display device, including the display panel described herein.

In a third aspect, an embodiment of the present disclosure provides a method for driving a display panel. The display panel is the display panel described herein, and the method includes a display phase and a blanking phase for one frame. The method includes: in the display phase of one frame, driving, by the pixel driving circuit of each sub-pixel unit, the light emitting unit of the sub-pixel unit to emit light; and in the blanking phase of one frame, randomly selecting a j-th row of sub-pixel units from all rows of sub-pixel units, and sensing the pixel driving circuit in the j-th row of sub-pixel units through the sensing circuit in the j-th row of sub-pixel units, where $1 \leq j \leq L$, j is an integer, and L is a number of the rows of sub-pixel units.

In some embodiments, the pixel driving circuit of the display panel includes a data writing circuit, a storage circuit and a driving circuit, the data writing circuit, the storage circuit and the driving circuit are coupled to a first node, the driving circuit, the storage circuit, the sensing circuit and the light emitting unit are coupled to a second node, and the display phase includes a data writing stage, a holding stage and a light-emitting stage;

in the data writing stage, a data signal provided by a corresponding data line is written into the first node through the data writing circuit; and an initial signal provided by a sensing signal line is written into the second node through the sensing circuit;

in the holding stage, a signal of the first node is kept as the data signal and a signal of the second node is kept as the initial signal by the capacitor circuit; and in the light-emitting stage, a driving current is provided to the second node through the driving circuit to drive the light emitting unit to emit light.

In some embodiments, the pixel driving circuit of the display panel includes a data writing circuit, a storage circuit and a driving circuit, the data writing circuit, the storage circuit and the driving circuit are coupled to a first node, the driving circuit, the storage circuit, the sensing circuit and the light emitting unit are coupled to a second node, and the blanking phase includes a restore stage, a charging stage, a sensing stage, a reset stage, and a data read-back stage;

in the restore stage, a data signal provided by a corresponding data line is written into the first node through the data writing circuit in the j-th row of sub-pixel units, and an initial signal provided by a sensing signal line is written into the second node through the sensing circuit in the j-th row of sub-pixel units;

in the charging stage, the sensing circuit is charged through the driving circuit in the j-th row of sub-pixel units;

in the sensing stage, a sensing voltage signal is sensed from the second node through the sensing circuit in the j-th row of sub-pixel units;

in the reset stage, the initial signal provided by the sensing signal line is written into the second node through the sensing circuit in the j-th row of sub-pixel units, so as to reset the second node; and in the data read-back stage, the data signal provided by the corresponding data line is written into the first node through the data writing circuit in the j-th row of sub-pixel units.

DETAILED DESCRIPTION

Figure 1:
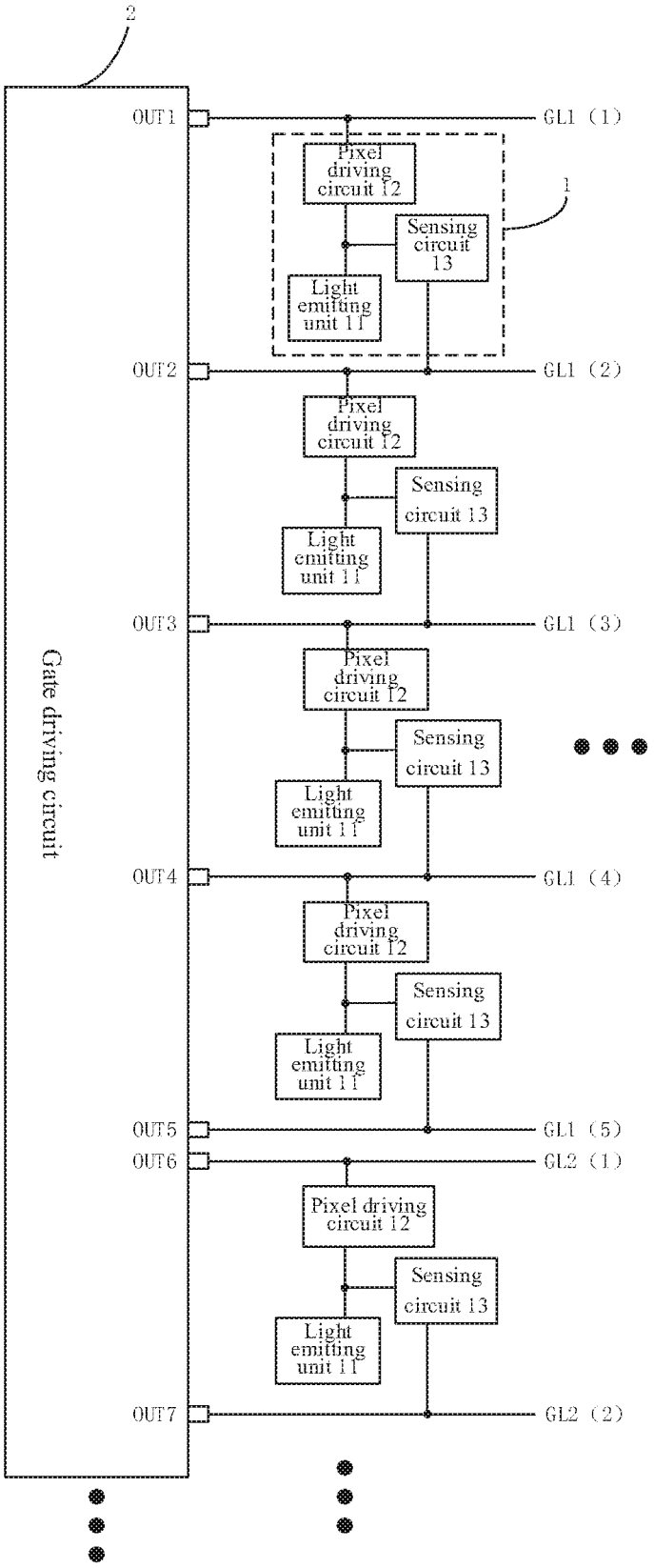
FIG. 1 is a schematic diagram illustrating a structure of a display panel according to an embodiment of the present disclosure.

In order to make those skilled in the art better understand the technical solutions of the embodiments of the present disclosure, a display panel, a method for driving the same and a display device provided in the embodiments of the present disclosure will be clearly and completely described below with reference to the accompanying drawings of the embodiments of the present disclosure.

Unless defined otherwise, technical or scientific terms used herein shall have the ordinary meaning as understood by one of ordinary skill in the art to which this disclosure belongs. The use of "first", "second", and the like in this disclosure is not intended to indicate any order, quantity, or importance, but rather is used to distinguish one element from another. Also, the use of the terms "a", "an", or "the" and similar terms do not denote a limitation of quantity, but rather denote the presence of at least one. The word "include" or "comprise", and the like, means that the element or item preceding the word includes the element or item listed after the word and its equivalent, but does not exclude other elements or items. The terms "connected" or "coupled" and the like are not restricted to physical or mechanical connections, but may include electrical connections, whether direct or indirect. The terms "upper", "lower", "left", "right", and the like are used only to indicate relative positional relationships, and when the absolute position of the object being described is changed, the relative positional relationships may also be changed accordingly.

It should be noted that the transistors in the embodiments of the present disclosure may be thin film transistors or field effect transistors or other switch devices having the same characteristics. Transistors generally include three electrodes: a gate electrode, a source electrode and a drain electrode. The source and drain electrodes in the transistor are symmetrical in structure, and may be interchangeable as desired. In the present disclosure, the control electrode refers to a gate electrode of the transistor, and one of the first electrode and the second electrode is a source electrode and the other is a drain electrode.

Further, transistors may be classified into N-type transistors and P-type transistors according to their characteristics. When the transistor is an N-type transistor, its turn-on voltage is a high-level voltage and its turn-off voltage is a low-level voltage. When the transistor is a P-type transistor, its turn-on voltage is a low-level voltage and its turn-off voltage is a high-level voltage. The "active level" in the embodiment of the present disclosure refers to a voltage capable of controlling the corresponding transistor to be turned on, and the "inactive level" refers to a voltage capable of controlling the corresponding transistor to be turned off. Thus, when the transistor is an N-type transistor, the active level refers to a high-level, and the inactive level refers to a low-level; when the transistor is a P-type transistor, the active level refers to a low-level and the inactive level refers to a high-level.

In the following description of the embodiments of the present disclosure, an example is given in which each transistor is an N-type transistor. In this case, the active level refers to a high-level, and accordingly, the active level state refers to a high-level state; the inactive level refers to a low-level, and accordingly, the inactive level state refers to a low-level state. It should be understood by those skilled in the art that each transistor in the embodiments of the present disclosure described below may also be a P-type transistor.

In the embodiments of the present disclosure, for the purpose of explanation, for the OLED display panel having an external compensation function, it is defined that the display of "one frame", "each frame", or "a certain frame" of image includes a display phase and a blanking phase which are sequentially performed. When compensating a sub-pixel unit in the OLED display panel, in addition to an internal compensation by arranging a pixel compensation circuit in the sub-pixel unit, an external compensation can be carried out by arranging a sensing transistor. In displaying one frame of image, a gate driving circuit composed of shift register units needs to supply driving signals for a scan transistor and a sensing transistor to sub-pixel units in the display panel, respectively. For example, in a display phase of one frame, the gate driving circuit may provide a scan driving signal for the scan transistor, and the scan driving signal may drive a plurality of rows of sub-pixel units in the display panel to complete a scan display of a complete image from a first row to a last row; in a blanking phase of one frame, the gate driving circuit may provide a sensing driving signal for the sensing transistor, and the sensing driving signal may be used to drive the sensing transistor in a row of sub-pixel units in the display panel to complete the external compensation for the row of sub-pixel units.

It should be noted that, for performing external compensation on the sub-pixel unit in the OLED display panel, reference may be made to existing compensation processes and principles in the art, and details are not described herein again.

As described above, when the gate driving circuit drives a plurality of rows of sub-pixel units in a display panel, if the external compensation is to be implemented, the gate driving circuit is required to output not only the scan driving signal for the display phase but also the sensing driving signal for the blanking phase. For example, for a display panel including N rows of sub-pixel units, 2N output terminals need to be provided for the gate driving circuit, and accordingly, the gate driving circuit needs to be provided with a corresponding number of transistors for outputting scan driving signals and sensing driving signals. In this case, the area occupied by the gate driving circuit may be relatively large, so that the size of the bezel of the display device using the gate driving circuit is increased, and it is difficult to increase PPI (Pixels Per Inch) of the display device, that is, it is difficult to satisfy the requirements of high resolution and narrow bezel of the display device.

On the other hand, in the case where high resolution and high performance are required, the requirement on the output capability of the transistor for outputting the gate scanning signal (e.g., scan driving signal, sensing driving signal) in the gate driving circuit is also high. However, the output capability of the transistor for outputting the gate scanning signal generally needs to be improved by increasing the width-to-length ratio of the transistor. In the case of increasing the width-to-length ratio of the transistor for outputting the gate scanning signal in the gate driving circuit, the area occupied by the gate driving circuit is increased, and the size of the bezel of the display device using the gate driving circuit is further increased, which makes it difficult to increase the PPI of the display device.

In view of the above technical problems, embodiments of the present disclosure provide a display panel including a gate line group, a gate driving circuit, and a sub-pixel unit group. The sub-pixel unit group includes N rows of sub-pixel units, the gate line group includes (N+1) gate lines, and N is an integer greater than or equal to 2. Each sub-pixel unit includes a light emitting unit, a pixel driving circuit configured to drive the light emitting unit to emit light, and a sensing circuit configured to sense the pixel driving circuit to enable external compensation of the sub-pixel unit. The gate driving circuit includes a plurality of output terminals arranged in sequence, and the gate driving circuit is configured to sequentially output gate scanning signals through the plurality of output terminals. Each gate line is coupled to one corresponding output terminal of the gate driving circuit. In the sub-pixel unit group, the pixel driving circuit in an n-th row of sub-pixel units is coupled to the gate line in an n-th row in the gate line group so as to receive the gate scanning signal transmitted by the gate line in the n-th row and use the gate scanning signal as a scan driving signal; the sensing circuit in the n-th row of sub-pixel units is coupled to the gate line in a (n+1)-th row in the gate line group to receive the gate scanning signal transmitted by the gate line in the (n+1)-th row and use the gate scanning signal as a sensing driving signal; where $1 \leq n \leq N$, and n is an integer.

In an embodiment of the present disclosure, the display panel includes a plurality of gate lines and a plurality of rows of sub-pixel units, the plurality of gate lines are divided into a plurality of gate line groups, the plurality of rows of sub-pixel units are divided into a plurality of sub-pixel unit groups, and the plurality of gate line groups and the plurality of sub-pixel unit groups are in one-to-one correspondence.

An embodiment of the present disclosure further provides a display device and a driving method corresponding to the above-described display panel.

According to the display panel, the display device and the driving method provided by the embodiments of the present disclosure, in each sub-pixel unit group, the sensing circuit in each row of sub-pixel units and the pixel driving circuit in the next row of pixel units share one gate line, so that the number of gate lines of the display panel, the number of output terminals of the gate driving circuit, the number of transistors for outputting gate scanning signals and the number of clock signal (CLK) lines can be effectively reduced. As a result, the bezel size of a display device adopting the gate driving circuit can be reduced, and the PPI of the display device can be improved, thereby realizing the high resolution and narrow bezel of the display device.

FIG. 1 is a schematic diagram illustrating a structure of a display panel according to an embodiment of the present disclosure. As shown in FIG. 1, the display panel includes a gate driving circuit 2, a plurality of gate lines GL, and a plurality of sub-pixel units 1 arranged in an array.

The plurality of sub-pixel units 1 arranged in an array may include L rows and M columns of sub-pixel units 1, each row of sub-pixel units 1 includes M sub-pixel units 1, and L and M are positive integers. Specific values of L and M may be determined according to actual situations, which is not specifically limited in the embodiment of the present disclosure. It should be noted that FIG. 1 only exemplarily shows 5 rows and 1 column of sub-pixel units 1, and the embodiment of the present disclosure is not limited thereto, and the display panel according to the embodiment of the present disclosure may further include more rows and more columns of sub-pixel units 1.

In an embodiment of the present disclosure, the L rows of sub-pixel units 1 are divided into a plurality of sub-pixel unit groups in advance, and the plurality of gate lines GL are divided into a plurality of gate line groups. Each sub-pixel unit group includes N rows of sub-pixel units, N is larger than or equal to 2, the sub-pixel unit groups and the gate line groups are arranged in a one-to-one correspondence manner, and each gate line group includes (N+1) gate lines GL. For convenience of understanding, as shown in FIG. 1, the gate line groups are denoted by GL1, GL2, . . . , and the like, and the gate lines GL in the gate line group are denoted by (1), (2), (3), . . . , and the like.

In an embodiment of the present disclosure, every four rows of sub-pixel units are taken as a sub-pixel unit group, that is, N is 4, and correspondingly, each gate line group includes five gate lines GL. It should be noted that FIG. 1 only exemplarily shows one complete sub-pixel unit group (including four rows of sub-pixel units 1) and one complete gate line group (including gate lines GL1(1), GL1(2), GL1(3), GL1(4), and GL1(5)), the embodiments of the present disclosure are not limited thereto, and the display panel in the embodiments of the present disclosure may further include more gate line groups and corresponding sub-pixel unit groups, each sub-pixel unit group may further include two rows, three rows, or more rows of sub-pixel units 1, and each gate line group may further include three, four, or more gate lines GL.

As shown in FIG. 1, the sub-pixel unit 1 includes a light emitting unit 11, a pixel driving circuit 12 configured to drive the light emitting unit 11 to emit light, and a sensing circuit 13 configured to sense the pixel driving circuit 12 to achieve external compensation of the sub-pixel unit. For example, in the display phase of one frame, the pixel driving circuit 12 in the sub-pixel unit 1 may drive the light emitting unit 11 to emit light; and in the blanking phase of one frame, the sensing circuit 13 in the sub-pixel unit 1 may sense the pixel driving circuit 12, thereby enabling external compensation of the sub-pixel unit 1.

As shown in FIG. 1, the gate driving circuit 2 includes a plurality of output terminals OUT (OUT1, OUT2, . . . , OUT7, etc.) arranged in sequence, and the plurality of output terminals OUT are coupled to the plurality of gate lines GL in a one-to-one correspondence. The gate driving circuit 2 is configured to output gate scanning signals to the plurality of gate lines GL through the plurality of output terminals OUT to turn on the L rows of sub-pixel units 1 arranged in the array row by row. For example, the gate scanning signals respectively output by the output terminals OUT of the gate driving circuit 2 may be consecutive or overlapped in timing, so that the L rows of sub-pixel units 1 arranged in the array may be turned on row by row. It should be noted that, the gate driving circuit 2 in FIG. 1 only exemplarily shows seven output terminals (OUT 1, OUT2, . . . , OUT 7), and the embodiment of the present disclosure is not limited thereto, and the gate driving circuit 2 in the embodiment of the present disclosure may set more output terminals OUT according to the number of actual gate lines GL.

In an embodiment of the present disclosure, in each sub-pixel unit group, the pixel driving circuit 12 in an n-th row of sub-pixel units 1 is coupled to a gate line GL in an n-th row in the corresponding gate line group to receive the gate scanning signal provided by the gate line in the n-th row as the scan driving signal. In the display phase of one frame, the scan driving signal may be used for turning on the pixel driving circuit 12, so as to drive the corresponding light emitting unit 11 to emit light. In the sub-pixel unit group, the sensing circuit 13 in the n-th row of sub-pixel units 1 is coupled to the gate line GL in a (n+1)-th row in the corresponding gate line group to receive the gate scanning signal provided by the gate line in the (n+1)-th row as a sensing driving signal. In the blanking phase of one frame, the sensing driving signal may be used for turning on the sensing circuit 13, so as to sense the pixel driving circuit 12; where $1 \leq n \leq N$. That is, the sensing circuit 13 in the n-th row of sub-pixel units 1 and the pixel driving circuit 12 in the (n+1)-th row of sub-pixel units 1 in each sub-pixel unit group are coupled to a same gate line GL, i.e., the gate line GL(n+1) in the (n+1)-th row in the corresponding gate line group.

For example, as shown in FIG. 1, in the first sub-pixel unit group, the pixel driving circuit 12 in the first row of sub-pixel units 1 is coupled to the gate line GL1(1) in the first row in the first gate line group GL1, the sensing circuit 13 in the first row of sub-pixel units 1 is coupled to the gate line GL1(2) in the second row in the first gate line group, the pixel driving circuit 12 in the second row of sub-pixel units 1 is coupled to the gate line GL1(2) in the second row in the first gate line group, the sensing circuit 13 in the second row of sub-pixel units 1 is coupled to the gate line GL1(3) in the third row in the first gate line group, the pixel driving circuit 12 in the third row of sub-pixel units 1 is coupled to the gate line GL1(3) in the third row in the first gate line group, the sensing circuit 13 in the third row of sub-pixel units 1 is coupled to the gate line GL1(4) in the fourth row in the first gate line group, the pixel driving circuit 12 in the fourth row of sub-pixel units 1 is coupled to the gate line GL1(4) in the fourth row in the first gate line group, the sensing circuit 13 in the fourth row of sub-pixel units 1 is coupled to the gate line GL1(5) in the fifth row in the first gate line group, and so on. The connection relationship between the pixel driving circuit 12, the sensing circuit 13 and the gate line GL in the second sub-pixel unit group, the third sub-pixel unit group and the like is similar to that described above, and the description thereof is omitted here.

It can be understood that, in each sub-pixel unit group, the sensing circuit 13 in the last row of sub-pixel units 1 and the pixel driving circuit 12 in a next row of sub-pixel units 1 do not share a same gate line GL, and the next row of sub-pixel units 1 is a first row of sub-pixel units 1 in a sub-pixel unit group next to the sub-pixel unit group. For example, as shown in FIG. 1, the sensing circuit 13 in the last row of the sub-pixel units 1 in the first sub-pixel unit group is coupled to the gate line GL1(5), the pixel driving circuit 12 in the first row of sub-pixel units 1 in the second sub-pixel unit group is coupled to the gate line GL2(1), and the gate lines GL1(5) and GL2(1) are two different gate lines.

As shown in FIG. 1, in the display panel provided by the present embodiment, a plurality rows of sub-pixel units 1 in each sub-pixel unit group and a plurality of gate lines GL in a corresponding gate line group are coupled as described above, such that the sensing circuit 13 in the n-th row of sub-pixel units 1 and the pixel driving circuit 12 in the (n+1)-th row of sub-pixel units 1 are both coupled to the gate line GL in the (n+1)-th row in the corresponding gate line group. As a result, the sensing circuit 13 in the n-th row of sub-pixel units 1 and the pixel driving circuit 12 in the (n+1)-th row of sub-pixel units 1 can share one output terminal OUT of the gate driving circuit 2 to which the gate line GL in the (n+1)-th row is coupled. Therefore, the number of the output terminals OUT of the gate driving circuit 2 can be effectively reduced, the size of a bezel of a display device adopting the display panel can be further reduced, and the PPI of the display device can be improved.

Figure 2:
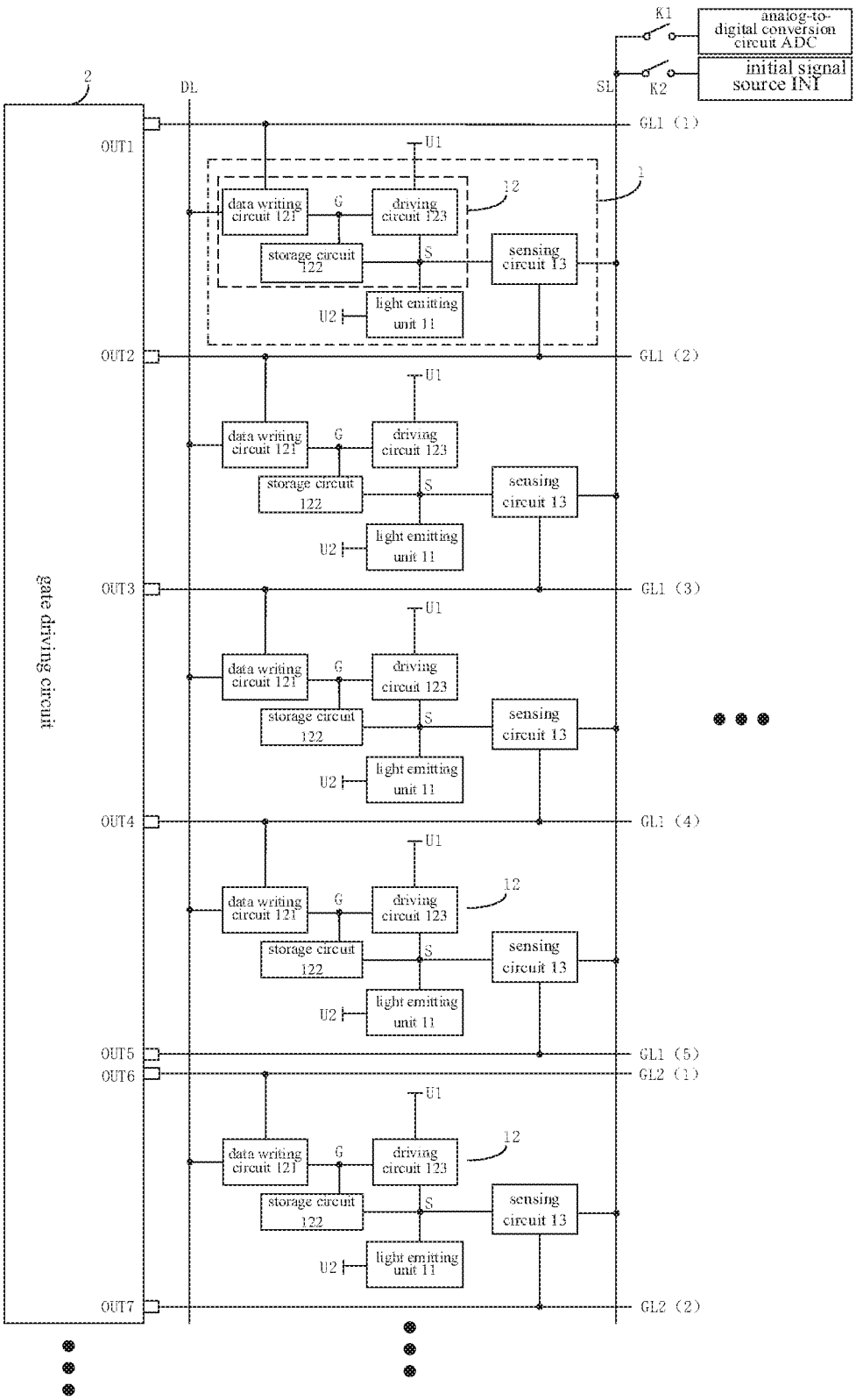
FIG. 2 is a schematic diagram illustrating a structure of an implementation of the display panel shown in FIG. 1.

FIG. 2 is a schematic diagram illustrating a structure of an implementation of the display panel shown in FIG. 1. In some embodiments of the present disclosure, the display panel further includes a plurality of sensing signal lines SL and a plurality of data lines DL corresponding to a plurality of columns of sub-pixel units 1 in a one-to-one correspondence manner, the number of the data lines DL is the same as the number of the columns of the sub-pixel units 1, that is, the number of the data lines is M, and the data lines DL and the gate lines GL cross over to each other to define the sub-pixel units 1.

In some embodiments of the present disclosure, one sensing signal line SL is provided for every m columns of sub-pixel units 1, where $m \geq 2$, and m is an integer. In some embodiments of the present disclosure, m is 6, i.e., one sensing signal line SL is provided for every six columns of sub-pixel units 1. It should be noted that FIG. 2 only exemplarily shows one data line DL and one sensing signal line SL, but the embodiments of the present disclosure are not limited thereto, and the number of the data lines DL and the sensing lines SL in the display panel may be set as needed.

In some embodiments of the present disclosure, as shown in FIG. 2, the pixel driving circuit 12 includes a data writing circuit 121, a storage circuit 122, and a driving circuit 123.

The data writing circuit 121, the storage circuit 122, and the driving circuit 123 are all coupled to a first node G and the driving circuit 123, the storage circuit 122, the sensing circuit 13, and the light emitting unit 11 are all coupled to a second node S; the driving circuit 123 is further coupled to a first power supply terminal U1, and the light emitting unit 11 is further coupled to a second power supply terminal U2. The first power supply terminal U1 is configured to supply a power supply voltage Vdd to the driving circuit 123, and the second power supply terminal U2 is configured to supply a low-level voltage Vss.

The data writing circuit 121 is further coupled to a corresponding gate line GL and a corresponding data line DL, and configured to receive a gate scanning signal provided by the corresponding gate line GL and write a data signal provided by the corresponding data line DL into the first node G in response to the control of the gate scanning signal. The data signal provided to the data writing circuit 121 by the corresponding data line DL may be a compensated data signal for light emission of the sub-pixel unit 1.

The driving circuit 123 is configured to receive the power supply voltage Vdd provided by the first power supply terminal U1 for generating a driving current, and to output the driving current to the second node S in response to the control of the signal in an active level state at the first node G to drive the light emitting unit 11 to emit light.

The sensing circuit 13 is further coupled to a corresponding sensing signal line SL and a corresponding gate line GL, and configured to receive a gate scanning signal provided by the corresponding gate line GL, to write an initial signal $V_{ini}$ output from the corresponding sensing signal line SL into the second node S or sense a sensing voltage signal from the second node S in response to the control of the gate scanning signal, and to output the sensing voltage signal through the corresponding sensing signal line SL. In an embodiment, the initial signal $V_{ini}$ is a low-level voltage signal.

The storage circuit 122 is configured to store the data signal written into the first node G and the initial signal $V_{ini}$ written into the second node S.

In some embodiments of the present disclosure, for each i columns of sub-pixel units 1, a power supply line (not shown) is provided, which is coupled to the driving circuit 123 corresponding to the i columns of sub-pixel units 1 via the first power supply terminal U1, and the power supply line is configured to provide a power supply voltage Vdd to a corresponding first power supply terminal U1, where i≥2. In some embodiments of the present disclosure, the display panel further includes a power chip (Power IC) (not shown), and each of the power supply lines is coupled to the power chip. The power chip (Power IC) is configured to supply a power supply voltage Vdd to a first power supply terminal U1 coupled to a power supply line through the power supply line. In some embodiments of the present disclosure, i is 6, that is, one power supply line is provided for every six columns of sub-pixel units 1.

In some embodiments of the present disclosure, as shown in FIG. 2, the display panel may further include a sensing chip (Sense IC), each sensing signal line SL is coupled to a corresponding sensing chip, and the sensing chip includes, but is not limited to, an analog-to-digital conversion circuit ADC and an initial signal source INI. The analog-to-digital conversion circuit ADC is coupled to a corresponding sensing signal line SL through a first switch K1, and the initial signal source INI is coupled to the corresponding sensing signal line SL through a second switch K2. When the initial signal $V_{ini}$ needs to be written into the second node S, the second switch K2 may be closed, and the first switch K1 may be opened, so that the initial signal source INI may output the initial signal $V_{ini}$ to the corresponding sensing signal line SL through the closed second switch K2; when the sensing voltage signal needs to be read from the second node S, the first switch K1 may be closed, and the second switch K2 may be opened, so that the analog-to-digital conversion circuit ADC may receive the sensing voltage signal read by the sensing circuit 13 from the second node S through the closed first switch K1.

In an embodiment of the present disclosure, the analog-to-digital conversion circuit is configured to perform an analog-to-digital conversion (converting an analog signal to a digital signal) on the sensing voltage signal for subsequent further data processing. For example, compensation information about the threshold voltage Vth and/or the driving current coefficient K in the driving circuit 123 can be obtained by processing the sensing voltage signal. For example, the sensing voltage signal may be obtained by the sensing circuit 13 in a blanking phase of a certain frame, and the compensation information about the threshold voltage Vth and/or the driving current coefficient K may be obtained by further data processing on the sensing voltage signal; then, in a display phase in the next frame, the light emitting unit 11 is driven again based on the compensation information obtained as described above, thereby completing the external compensation of the sub-pixel unit 1.

Figure 3:
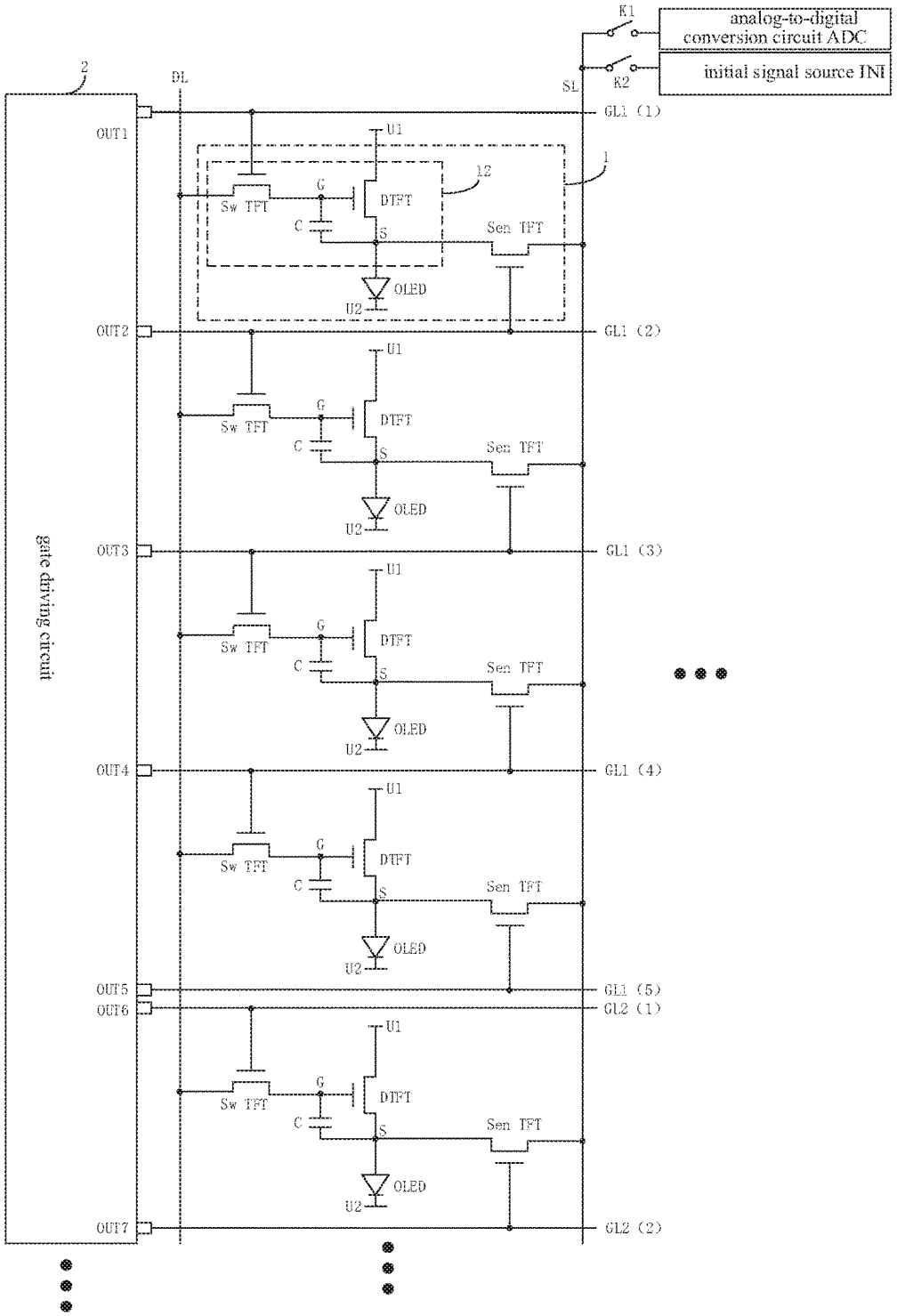
FIG. 3 is a schematic diagram illustrating a structure of an implementation of the display panel shown in FIG. 2.

FIG. 3 is a schematic diagram illustrating a structure of an implementation of the display panel shown in FIG. 2. In some embodiments of the present disclosure, as shown in FIGS. 2 and 3, the data writing circuit 121 includes a scan transistor Sw TFT having a first electrode coupled to a corresponding data line DL, a second electrode coupled to the first node G and a control electrode coupled to a corresponding gate line GL.

As shown in FIGS. 2 and 3, the driving circuit 123 includes a driving transistor DTFT having a first electrode coupled to the first power supply terminal U1, a second electrode coupled to the second node S, and a control electrode coupled to the first node G.

As shown in FIGS. 2 and 3, the storage circuit 122 includes a storage capacitor C having a first terminal coupled to the first node G and a second terminal coupled to the second node S.

As shown in FIGS. 2 and 3, the sensing circuit 13 includes a sensing transistor Sen TFT having a first electrode coupled to a corresponding sensing signal line SL, a second electrode coupled to the second node S, and a control electrode coupled to a corresponding gate line GL.

As shown in FIGS. 2 and 3, the light emitting unit 11 includes an organic light emitting diode OLED having a first electrode coupled to the second node S and a second electrode coupled to the second power supply terminal U2. The organic light emitting diode OLED may be of various types, such as a top emission type, a bottom emission type, and the like, and may emit red, green, blue, or white light, and the like, which is not limited by the embodiments of the present disclosure.

Figure 4:
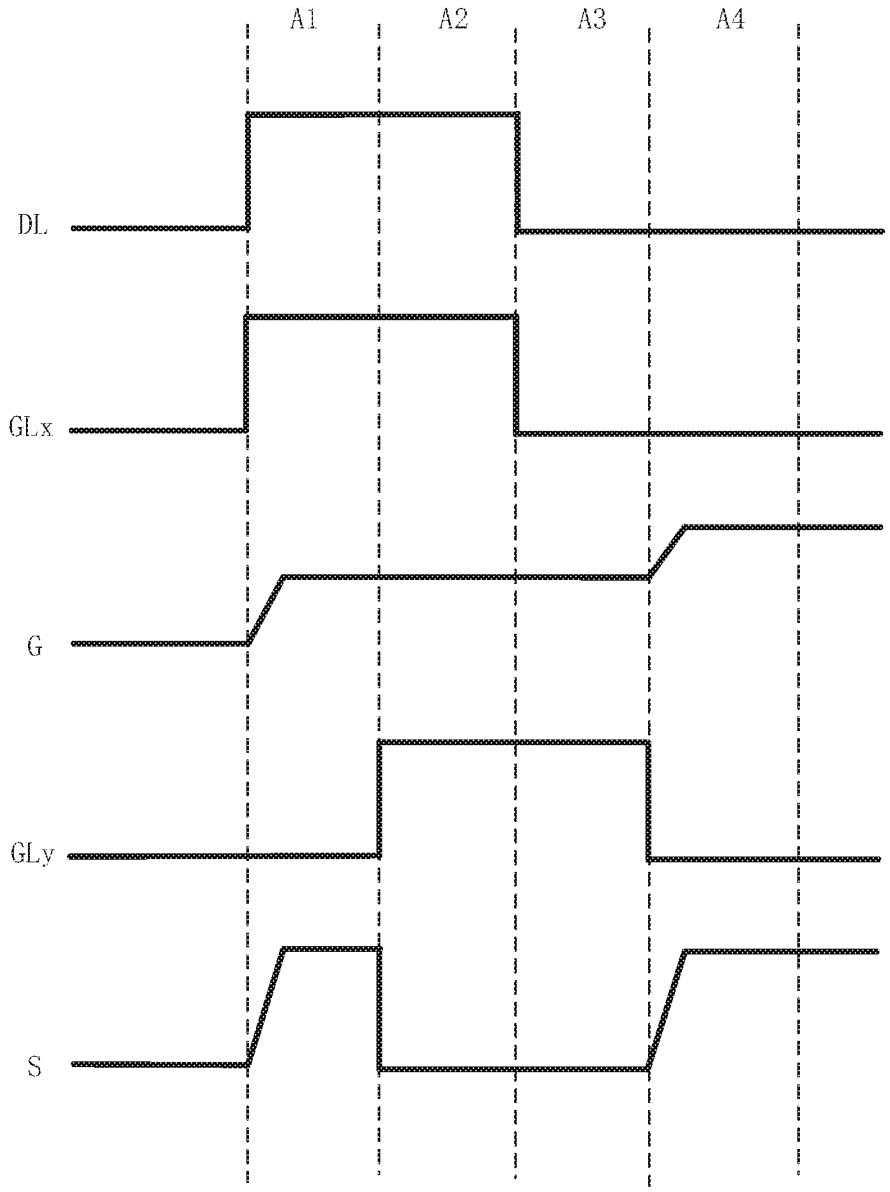
FIG. 4 is a timing diagram of signals of the display panel shown in FIG. 3 during a display phase of one frame.

FIG. 4 is a timing diagram of signals of the display panel shown in FIG. 3 during a display phase of one frame. The operation of one sub-pixel unit 1 in the display panel shown in FIG. 3 during the display phase of one frame will be described with reference to the display panel shown in FIG. 3 and the timing diagram of the signals shown in FIG. 4. Here, the description is made by taking N-type transistors as examples of transistors, but embodiments of the present disclosure are not limited thereto. It should be noted that the signal levels in the timing diagram of the signals shown in FIG. 4 are only schematic and do not represent real values of the levels.

In FIG. 4, DL represents a signal timing of a data line to which the first electrode of the scan transistor Sw TFT in the sub-pixel unit 1 is coupled, GLx represents a signal timing of a gate line to which the control electrode of the scan transistor Sw TFT in the sub-pixel unit 1 is coupled, G represents a signal timing of a first node G, GLy represents a signal timing of a gate line to which the control electrode of the sensing transistor Sen TFT in the sub-pixel unit 1 is coupled, and S represents a signal timing of a second node S.

As shown in FIGS. 3 and 4, in a first stage A1, a gate line GLx provides a high-level signal, the scan transistor Sw TFT is turned on under the control of the high-level signal provided by the gate line GLx, and a non-current-row data signal provided by the data line DL is written into the first node G through the turned-on scan transistor Sw TFT, so that the potential at the first node G becomes high; a gate line GLy provides a low-level signal and the sensing transistor Sen TFT is turned off. Due to the bootstrap effect of the storage capacitor C, the potential at the second node S becomes higher as the potential at the first node G becomes higher.

In a second stage (data writing stage) A2, the gate line GLx provides a high-level signal, the gate line GLy provides a high-level signal, the scan transistor Sw TFT is kept on, and the sensing transistor Sen TFT is turned on under the control of the high-level signal provided by the gate line GLy. In this stage, the sensing signal line SL writes an initial signal $V_{ini}$, which is a low-level signal (e.g., 0V), into the second node S through the turned-on sensing transistor Sen TFT. In this stage, a current-row data signal provided by the data line DL, which may be a compensated data signal for driving the sub-pixel unit in a current row to emit light, is written into the first node G through the turned-on scan transistor Sw TFT. The compensated data signal may be a data signal compensated by using a threshold voltage Vth, for example, the written current-row data signal Vdata'=Vdata+Vth, where Vdata is a data signal before compensation, Vdata' is a compensated data signal, and Vth is a threshold voltage of the driving transistor DTFT. The threshold voltage Vth may be obtained while the display device is in standby, and may also be obtained based on the sensing result of the sensing circuit 13 in the blanking phase(s) of the previous frame(s). The process of obtaining the threshold voltage Vth for threshold compensation can refer to the conventional method, and is not described in detail herein.

If the compensation information about the driving current coefficient K of the driving transistor DTFT of the sub-pixel unit 1 in a current row has been obtained based on a sensing result of the sensing circuit 13 in a blanking phase of any one of previous frames of a frame, the current-row data signal written in the data writing stage of the frame may be a data signal compensated with the drive current coefficient for driving the sub-pixel unit 1 in the current row to emit light, or a data signal compensated with the threshold value and the driving current coefficient for driving the sub-pixel unit 1 in the current row to emit light.

In a third stage (holding stage) A3, the gate line GLx provides a low-level signal, the gate line GLy provides a high-level signal, the scan transistor Sw TFT is turned off, and the sensing transistor Sen TFT is kept on. Therefore, the second node S keeps the written initial signal $V_{ini}$, i.e., the potential a the second node S, constant, so that the potential at the first node G is also kept constant by the storage capacitor C.

In a fourth stage (light-emitting stage) A4, the gate line GLx provides a low-level signal, the gate line GLy provides a low-level signal, the scan transistor Sw TFT is turned off, and the sensing transistor Sen TFT is turned off. The driving transistor DTFT is turned on in response to the control of the potential at the first node G and the potential at the second node S, and the first power supply terminal U writes the power supply voltage Vdd into the second node S through the turned-on driving transistor DTFT to charge the second node S such that the potential at the second node S becomes high, thereby driving the organic light emitting diode OLED to emit light. Meanwhile, when the potential at the second node S becomes high, the potential at the first node G also becomes higher due to the bootstrap effect of the storage capacitor C.

Figure 5:
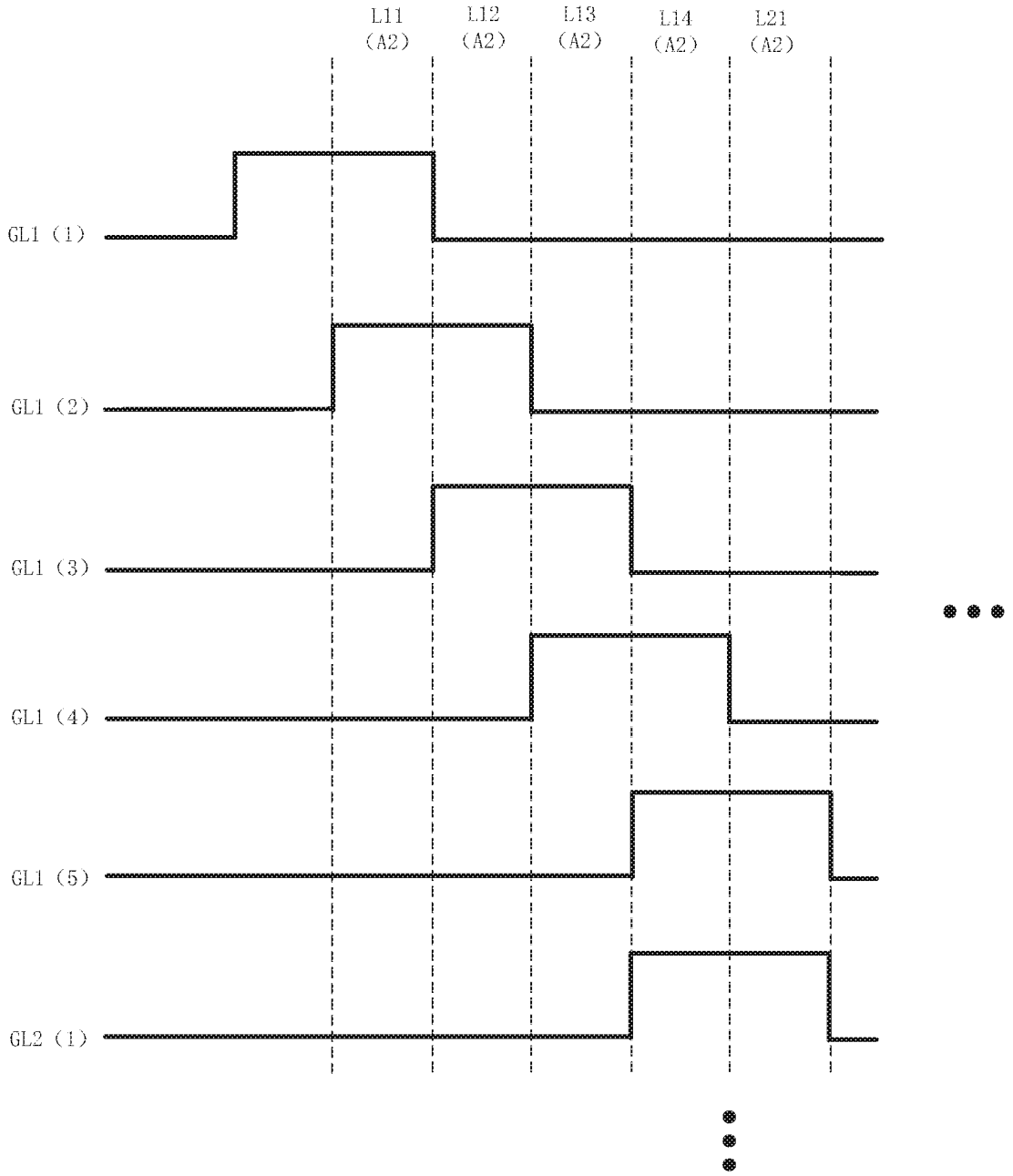
FIG. 5 is a timing diagram of signals of gate lines shown in FIG. 3 during a display phase of one frame.

FIG. 5 is a timing diagram of signals of gate lines shown in FIG. 3 during a display phase of one frame. As shown in FIGS. 3 and 5, L11(A2) is a data writing stage A2 of the first row of sub-pixel units 1 in the first sub-pixel unit group, L12(A2) is a data writing phase A2 of the second row of sub-pixel units 1 in the first sub-pixel unit group, L13(A2) is a data writing phase A2 of the third row of sub-pixel units 1 in the first sub-pixel unit group, L14(A2) is a data writing phase A2 of the fourth row of sub-pixel units 1 in the first sub-pixel unit group, L21(A2) is a data writing phase A2 of the first row of sub-pixel units 1 in the second sub-pixel unit group, and so on.

It should be noted that, in some embodiments of the present disclosure, in the display phase of one frame, a gate line GL in a last row in a gate line group corresponding to a sub-pixel unit group and a gate line GL in a first row in a gate line group corresponding to a sub-pixel unit group adjacent to the sub-pixel unit group have a same signal timing. For example, as shown in FIGS. 3 and 5, in the display phase of one frame, the gate line GL1(5) in the first gate line group corresponding to the first sub-pixel unit group and the gate line GL2(1) in the second gate line group corresponding to the second sub-pixel unit group have a same signal timing. FIG. 5 only exemplarily shows timings of signals of the gate lines GL1(1) to GL 1(5) in the first gate line group corresponding to the first sub-pixel unit group and the gate line GL2(1) in the first row in the second gate line group corresponding to the second sub-pixel unit group in the display phase of one frame. For the relationship between the timings of signals of gate lines in gate line groups corresponding to other sub-pixel unit groups, reference may be made to the relationship between the timings of the signals of the gate lines corresponding to the first sub-pixel unit group shown in FIG. 5, which is not described in detail herein.

In some embodiments of the present disclosure, in the light-emitting stage A4, it can be known from the formula of the saturation driving current of the driving transistor DTFT that: $I_{oled}=K*(Vgs-Vth)^2$, where $I_{oled}$ is a driving current output from the driving transistor DTFT, K is a driving current coefficient related to process parameters and geometry of the driving transistor DTFT, K=(½)*μn*Cox*(W/L), Vgs is a gate-source voltage of the driving transistor DTFT, Vgs is equal to a difference between a voltage at the first node G and a voltage at the second node S, and Vth is a threshold voltage of the driving transistor DTFT. As can be seen from the above driving current formula, in addition to the threshold voltage Vth affecting the driving current, the driving current coefficient K also affects the driving current $I_{oled}$. For example, during the use of the display device, the mobility of the driving transistor DTFT increases due to the temperature increase, and the driving current coefficient K varies due to the correlation between the driving current coefficient K and the mobility, so that the driving current $I_{oled}$ provided by the driving transistor DTFT is affected. As a result, display brightness, power consumption, and service life of the display device are affected.

For this reason, in some embodiments of the present disclosure, in the blanking phase of one frame, a sensing voltage signal may be obtained by the sensing circuit 13, and the compensation information about the threshold voltage Vth and/or the driving current coefficient K in the driving transistor DTFT may be obtained by further data processing on the sensing voltage signal; then, in the display phase of the next frame, the organic light emitting diode OLED is driven according to the obtained compensation information, so that the external compensation of the sub-pixel unit 1 is completed, and the display brightness, the power consumption and the service life of the display device are effectively ensured.

Figure 6:
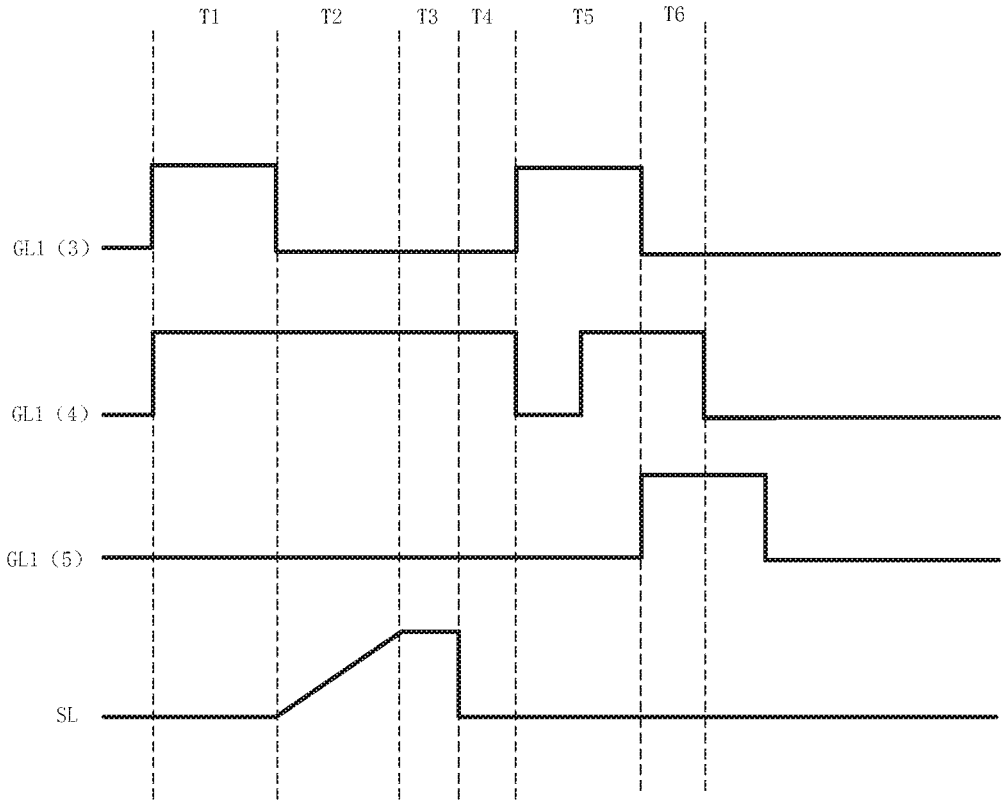
FIG. 6 is a timing diagram of signals of the display panel shown in FIG. 3 during a blanking phase of one frame.

FIG. 6 is a timing diagram of signals of the display panel shown in FIG. 3 during a blanking phase of one frame. The operation of the display panel shown in FIG. 3 in the blanking phase of one frame will be described with reference to the display panel shown in FIG. 3 and the timing diagram of the signals shown in FIG. 6. Here, the description is made by taking N-type transistors as examples of transistors, but embodiments of the present disclosure are not limited thereto. It should be noted that the signal levels in the timing diagram of the signals shown in FIG. 6 are only schematic and do not represent real values of the levels.

In the following description, in the blanking phase of the frame, an example will be described in which the third row of sub-pixel units 1 in the first sub-pixel unit group is sensed.

In FIG. 6, GL1(3) represents a signal timing of a gate line to which a control electrode of the scan transistor Sw TFT in a third row of sub-pixel units 1 in the first sub-pixel unit group is coupled, GL1(4) represents a signal timing of a gate line to which a control electrode of the sensing transistor Sen TFT in the third row of sub-pixel units 1 is coupled, GL1(5)

represents a signal timing of a gate line to which a control electrode of the sensing transistor Sen TFT in a fourth row of sub-pixel units 1 in the first sub-pixel unit group is coupled, and SL represents a signal timing of a sensing signal line to which a first electrode of the sensing transistor Sen TFT in the third row of sub-pixel units 1 is coupled.

As shown in FIGS. 3 and 6, in a restore stage T1, the gate line GL1(3) outputs a high-level signal, and the gate line GL1(4) outputs a high-level signal. In the third row of sub-pixel units 1 in the first sub-pixel unit group, the scan transistor Sw TFT is turned on under the control of the high-level signal output from the gate line GL1(3), and the sensing transistor Sen TFT is turned on under the control of the high-level signal output from the gate line GL1(4). In this stage, a data signal provided by the data line DL, which may be the same as the data signal written to the third row of sub-pixel units 1 in the data writing stage A2 described above, is written to the first node G through the turned-on scan transistor Sw TFT. In this stage, the sensing signal line SL writes an initial signal $V_{ini}$, which is a low-level signal (e.g., 0V), into the second node S through the turned-on sensing transistor Sen TFT, thereby turning on the driving transistor DTFT in the third row of sub-pixel units 1.

In a charging stage T2, the gate line GL1(3) provides a low-level signal, and the gate line GL1(4) provides a high-level signal. In the third row of sub-pixel units 1 in the first sub-pixel unit group, the scan transistor Sw TFT is turned off, and the sensing transistor Sen TFT is kept on. The potential at the first node G and the potential at the second node S are kept constant by the storage capacitor, so that the driving transistor DTFT is kept on. Meanwhile, in this stage, the sensing signal line SL is disconnected from the sensing chip, that is, the sensing signal line SL is in a floating (Floating) state, and the first power supply terminal U1 charges the sensing signal line SL through the turned-on driving transistor DTFT and the turned-on sensing transistor Sen TFT, so that the potential at the sensing signal line SL becomes high. After charging for a period of time, the potential at the second node S remains substantially unchanged, and the potential at the sensing signal line SL remains substantially unchanged.

In a sensing stage T3, the gate line GL1(3) provides a low-level signal, and the gate line GL1(4) provides a high-level signal. In the third row of sub-pixel units 1 in the first sub-pixel unit group, the scan transistor Sw TFT is turned off, and the sensing transistor Sen TFT is kept on. Meanwhile, in this stage, the sensing signal line SL is coupled to the analog-to-digital conversion circuit of the sensing chip, and the potential (i.e., the sensing voltage signal) of the second node S is output to the analog-to-digital conversion circuit of the sensing chip through the sensing signal line SL, so as to facilitate subsequent further data processing. For example, compensation information about the threshold voltage Vth and/or the driving current coefficient K of the driving transistor DTFT may be obtained by processing the sensing voltage signal, and then the light emitting unit 11 may be driven according to the obtained compensation information in the display phase of the next frame, thereby completing the external compensation of the sub-pixel unit 1. It should be noted that the process of obtaining the compensation information about the threshold voltage Vth and/or the driving current coefficient K of the driving transistor DTFT by processing the sensing voltage signal is a conventional technology in the art, and is not described in detail here.

In a reset stage T4, the gate line GL1(3) provides a low-level signal, and the gate line GL1(4) provides a high-level signal. In the third row of sub-pixel units 1 in the first sub-pixel unit group, the scan transistor Sw TFT is turned off, and the sensing transistor Sen TFT is kept on. Meanwhile, in this stage, the sensing signal line SL is coupled to the initial signal source INI of the sensing chip. In the third row of sub-pixel units 1 in the first sub-pixel unit group, the sensing signal line SL writes an initial signal $V_{ini}$, which is a low-level signal (e.g., 0V), into the second node S through the turned-on sensing transistor Sen TFT, thereby resetting the second node S.

In a data read-back stage T5, the gate line GL1(3) provides a high-level signal, and the gate line GL1(4) provides a low-level signal first and then provides a high-level signal. In the third row of sub-pixel units 1 in the first sub-pixel unit group, the scan transistor Sw TFT is turned on, and the sensing transistor Sen TFT is turned on after being turned off. In this stage, in the third row of sub-pixel units 1 in the first sub-pixel unit group, the data signal provided by the data line DL, which may be the same as the data signal written to the third row of sub-pixel units 1 in the data writing stage A2 described above, is written into the first node G through the turned-on scan transistor Sw TFT, and the sensing signal line SL writes an initial signal $V_{ini}$, which is a low-level signal (e.g., 0V), into the second node S through the turned-on sensing transistor Sen TFT. In this way, after the third row of sub-pixel units 1 in the first sub-pixel unit group is sensed, data read-back (Read Back) is performed on the third row of sub-pixel units 1 to ensure that the third row of sub-pixel units 1 can display normally, and the phenomenon of displaying a dark line after sensing is effectively prevented.

When the gate line GL1(4) outputs a high-level signal in the process of sensing the third row of sub-pixel units 1 in the first sub-pixel unit group, the first node G in the fourth row of sub-pixel units 1 in the first sub-pixel unit group is written with a data signal for driving the third row of sub-pixel units 1 to emit light, which may result in that the fourth row of sub-pixel units 1 in the first sub-pixel unit group cannot emit light. Therefore, after sensing the third row of sub-pixel units 1 in the first sub-pixel unit group, data read-back (Read Back) needs to be performed on the fourth row of sub-pixel units 1 in the first sub-pixel unit group to ensure that the fourth row of sub-pixel units 1 can display normally, and the phenomenon of displaying a dark line is effectively prevented.

In a data read-back stage T6, the gate line GL1(4) provides a high-level signal, and the gate line GL1(5) provides a high-level signal. In the fourth row of sub-pixel units 1 in the first sub-pixel unit group, the scan transistor Sw TFT is turned on, and the sensing transistor Sen TFT is kept on. The data signal provided by the data line DL, which may be the same as the data signal written to the fourth row of sub-pixel units 1 in the data writing phase A2 described above, is written to the first node G in the fourth row of sub-pixel units 1 through the turned-on scan transistor Sw TFT. At the same time, the sensing signal line SL writes an initial signal $V_{ini}$, which is a low-level signal (e.g., 0V), into the second node S in the fourth row of sub-pixel units 1 through the turned-on sensing transistor Sen TFT. In this way, after the third row of sub-pixel units 1 in the first sub-pixel unit group is sensed, data read-back (Read Back) is performed on the fourth row of sub-pixel units 1 in the first sub-pixel unit group to ensure that the fourth row of sub-pixel units 1 can display normally, and the phenomenon of displaying a dark line is effectively prevented.

Figure 7:
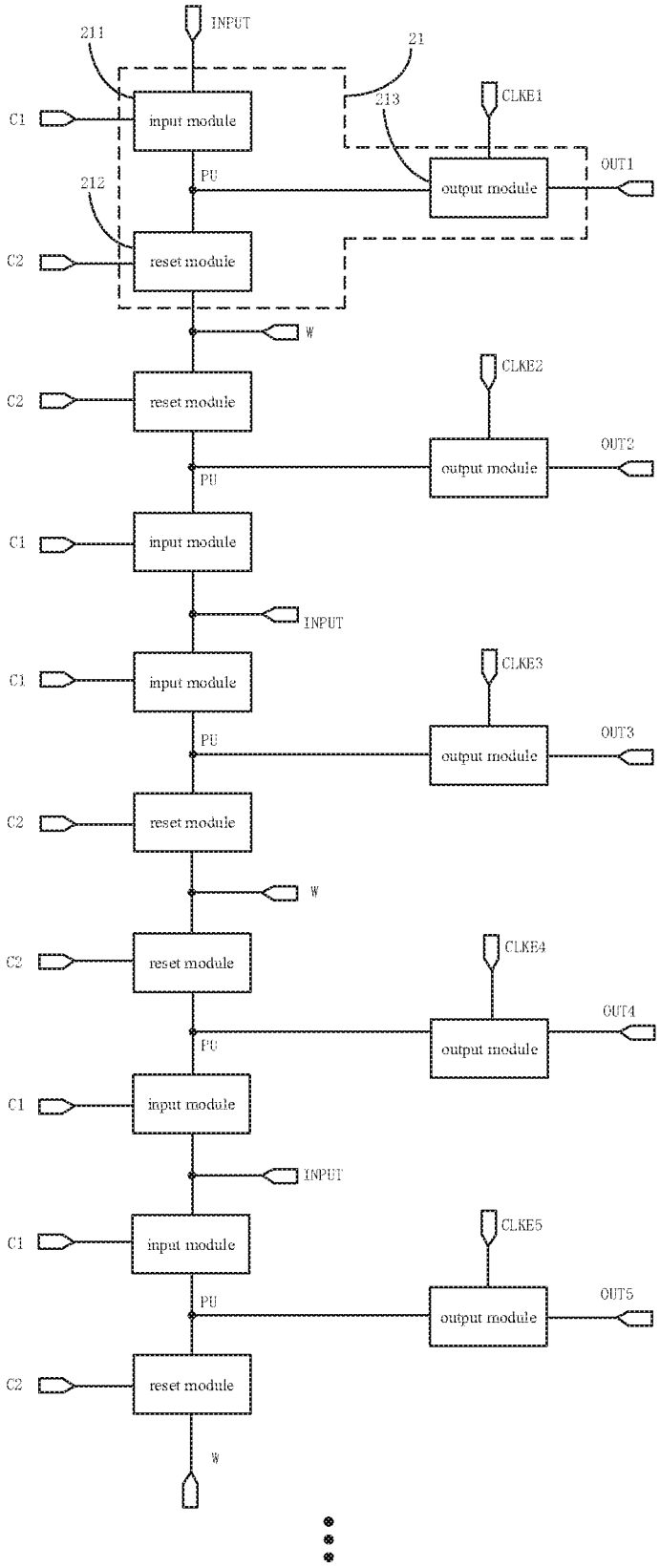
FIG. 7 is a schematic diagram illustrating a structure of a gate driving circuit in the display panel shown in FIG. 1.

FIG. 7 is a schematic diagram illustrating a structure of a gate driving circuit in the display panel shown in FIG. 1. In some embodiments of the present disclosure, as shown in FIGS. 1 and 7, the gate driving circuit 2 includes a plurality of cascaded shift register units 21.

In some embodiments of the present disclosure, as shown in FIG. 7, each shift register unit 21 includes one output terminal OUT, and each output terminal OUT is coupled to a corresponding gate line GL. Each shift register unit 21 may be configured to provide a gate scanning signal to a corresponding gate line GL.

In some embodiments of the present disclosure, as shown in FIG. 7, each shift register unit 21 includes, but is not limited to, an input module 211, a reset module 212 and an output module 213. The input module 211 is coupled to a signal input terminal INPUT, a first control terminal C1 and a pull-up node PU, and the input module 211 is configured to write an input signal provided by the signal input terminal INPUT into the pull-up node PU in response to the control of a first control signal in an active level state provided by the first control terminal C1, so as to charge the pull-up node PU.

The output module 213 is coupled to the pull-up node PU, a first clock signal terminal CLKE, and the output terminal OUT, and the output module 213 is configured to transmit a first clock signal provided by the first clock signal terminal CLKE to the output terminal OUT in response to the control of the potential at the pull-up node PU.

The reset module 212 is coupled to the pull-up node PU, a second control terminal C2 and a third power supply terminal W, and the reset module 212 is configured to write a third power supply signal provided by the third power supply terminal W into the pull-up node PU in response to the control of a second control signal in an active level state provided by the second control terminal C2, so as to reset the pull-up node PU.

In some embodiments of the present disclosure, a plurality of cascaded shift register units 21 may be divided into a plurality of gate driving sub-circuits, and the plurality of gate driving sub-circuits are arranged in one-to-one correspondence with a plurality of gate line groups. Each gate driving sub-circuit includes a plurality of cascaded shift register units 21, and the number of the shift register units 21 in each gate driving sub-circuit is the same as the number of the gate lines GL in a corresponding gate line group, that is, the number of the shift register units in each gate driving sub-circuit is N+1. For example, as shown in FIGS. 1 and 7, the number of the shift register units 21 in each gate driving sub-circuit is five, and the output terminals OUT of the five shift register units 21 are respectively an output terminal OUT1 coupled to the gate line GL1(1), an output terminal OUT2 coupled to the gate line GL1(2), an output terminal OUT3 coupled to the gate line GL1(3), an output terminal OUT4 coupled to the gate line GL1(4), and an output terminal OUT5 coupled to the gate line GL1(5).

It should be noted that FIG. 7 only exemplarily shows the structure of one gate driving sub-circuit of the gate driving circuit 2. As for the structure of the rest gate driving sub-circuits of the gate driving circuit 2, the structure of the gate driving sub-circuit shown in FIG. 7 can be referred to, and details are not repeated here.

In the embodiment of the present disclosure, since the number of gate lines is reduced, the number of shift register units and the number of output terminals in the gate driving circuit can be reduced, so that the size of a bezel of a display device adopting the gate driving circuit can be reduced, the PPI of the display device can be improved, and high resolution and a narrow bezel of the display device can be implemented.

Figure 8:
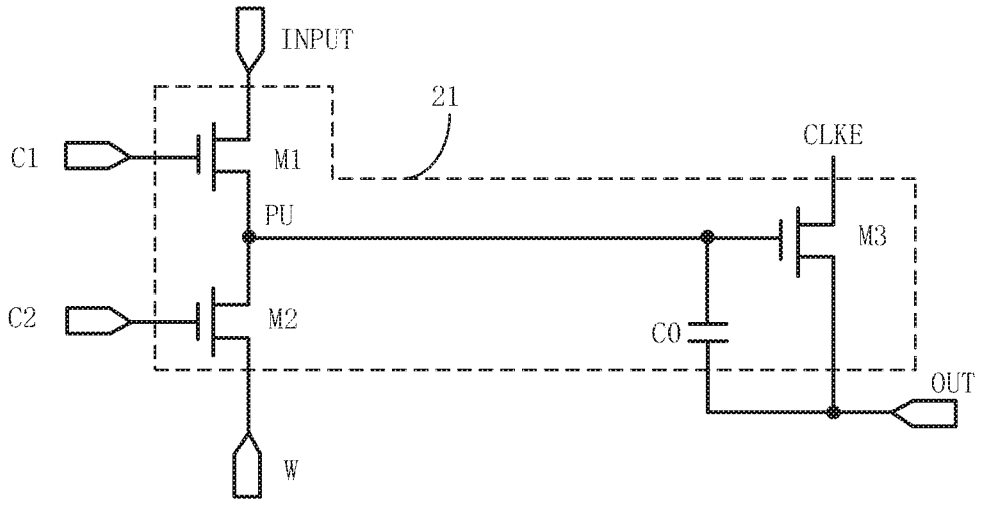
FIG. 8 is a schematic diagram illustrating an implementation of a shift register unit shown in FIG. 7.

FIG. 8 is a schematic diagram illustrating a structure of an implementation of the shift register unit shown in FIG. 7. In some embodiments of the present disclosure, as shown in FIGS. 7 and 8, the input module 211 includes a first transistor M1 having a first electrode coupled to the signal input terminal INPUT, a second electrode coupled to the pull-up node PU, and a control electrode coupled to the first control terminal C1.

The reset module 212 includes a second transistor M2 having a first electrode coupled to the third power supply terminal W, a second electrode coupled to the pull-up node PU, and a control electrode coupled to the second control terminal C2.

The output module 213 includes a capacitor C0 and a third transistor M3, a first electrode of the third transistor M3 is coupled to the first clock signal terminal CLKE, a second electrode of the third transistor M3 is coupled to the output terminal OUT, and a control electrode of the third transistor M3 is coupled to the pull-up node PU; a first terminal of the capacitor C0 is coupled to the pull-up node PU, and a second terminal of the capacitor C0 is coupled to the second electrode of the third transistor M3.

Furthermore, in some embodiments of the present disclosure, the input signal provided by the signal input terminal INPUT is a high-level signal Vdd; the third power signal provided by the third power supply terminal W is a low-level signal VGL; the signal provided by the first control terminal C1 is a carry signal, and the signal provided by the second control terminal C2 is a carry signal. For each shift register unit 21, the timing of the signal provided by the first control terminal C1, the signal provided by the second control terminal C2, and the signal provided by the first clock signal terminal CLKE may be set according to actual needs, for example, according to the timing of the signals of the gate lines shown in FIGS. 5 and 6, which is not repeated herein.

Figure 9:
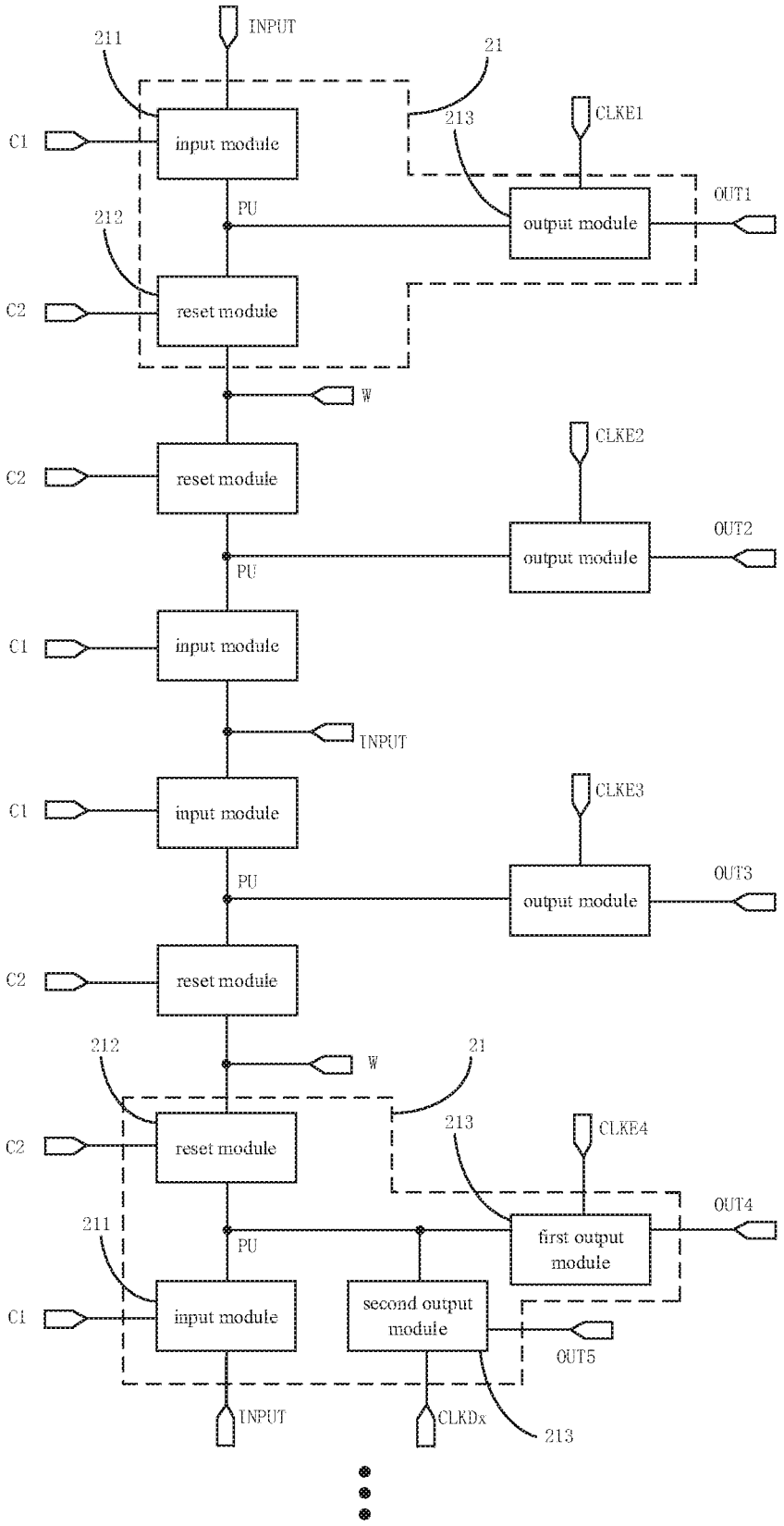
FIG. 9 is a schematic diagram illustrating a structure of another gate driving circuit in the display panel shown in FIG. 1.

FIG. 9 is a schematic diagram illustrating a structure of another gate driving circuit in the display panel shown in FIG. 1. As shown in FIG. 9, the structure of the gate driving circuit is different from that of any of the above embodiments in that: in some embodiments of the present disclosure, the number of shift register units 21 in each gate driving sub-circuit is N, i.e., the number of shift register units 21 in each gate driving sub-circuit is the same as the number of rows of sub-pixel units 1 in a corresponding sub-pixel unit group. For example, as shown in FIGS. 1 and 9, N is 4, that is, the number of shift register units 21 in each gate driving sub-circuit is four.

In some embodiments of the present disclosure, as shown in FIGS. 1 and 9, in each gate driving sub-circuit, a last stage (i.e., an N-th stage) of shift register unit 21 has two output terminals OUT, and the N-th stage of shift register unit 21 includes two output modules 213, which are a first output module 213 and a second output module 213, respectively.

As shown in FIGS. 1 and 9, the first output module 213 is coupled to a pull-up node PU, a first clock signal terminal CLKE4, and an output terminal OUT4, and the first output module 213 is configured to transmit a first clock signal provided by the first clock signal terminal CLKE4 to the output terminal OUT4 in response to the control of the potential at the pull-up node PU.

The second output module 213 is coupled to the pull-up node PU, a second clock signal terminal CLKDx, and an output terminal OUT5, and the second output module 213 is configured to transmit a second clock signal provided by the second clock signal terminal CLKDx to the output terminal OUT5 in response to the control of the potential at the pull-up node PU.

The output terminal OUT4 coupled to the first output module 213 is coupled to a gate line GL in an N-th row in a corresponding gate line group, and the output terminal OUT5 coupled to the second output module 213 is coupled to a gate line GL in a (N+1)-th row in the corresponding gate line group. For example, as shown in FIGS. 1 and 9, N is 4, the first output module 213 of the last stage (i.e., the fourth stage) of shift register unit 21 in the first gate driving sub-circuit is coupled to the output terminal OUT4, and the output terminal OUT4 is coupled to the gate line GL1(4) in the fourth row in the first gate line group corresponding to the first gate driving sub-circuit; the second output module 213 is coupled to the output terminal OUT5, and the output terminal OUT5 is coupled to the gate line GL1(5) in the fifth row in the first gate line group corresponding to the first gate driving sub-circuit.

In some embodiments of the present disclosure, as shown in FIG. 9, in the gate driving circuit 2, a first control terminal C1 corresponding to the first gate driving sub-circuit is coupled to a first external clock signal terminal, which may be configured to provide a clock signal as a carry signal to the first control terminal C1 corresponding to the first gate driving sub-circuit; the first control terminal C1 corresponding to an h-th gate driving sub-circuit is coupled to an output terminal OUT corresponding to the second output module 213 of an N-th stage of shift register unit 21 in a (h−1)-th gate driving sub-circuit, where h is greater than or equal to 2 and less than or equal to a total number of the gate driving sub-circuits, and k is an integer.

In some embodiments of the present disclosure, as shown in FIG. 9, in the gate driving circuit 2, the second control terminals C2 corresponding to the last seven gate driving sub-circuits are respectively coupled to a second external clock signal terminal, which may be configured to provide a clock signal as a carry signal to the second control terminals C2 corresponding to the last seven gate driving sub-circuits; the second control terminal C2 corresponding to an f-th gate driving sub-circuit is coupled to an output terminal OUT corresponding to the second output modules 213 of the N-th stage of shift register unit 21 in a (f+7)-th gate driving sub-circuit, where f is greater than or equal to 1 and less than or equal to the total number of the gate driving sub-circuits minus seven, and f is an integer.

Figure 10:
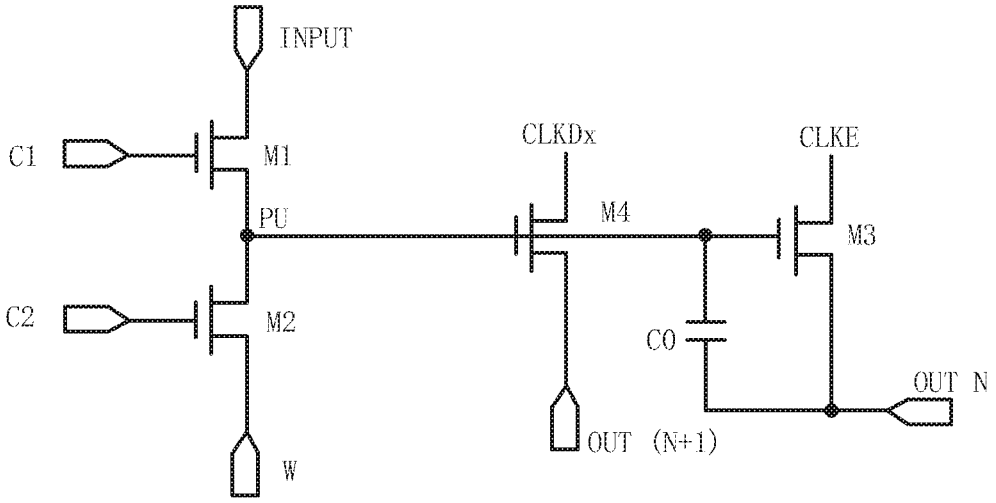
FIG. 10 is a schematic diagram illustrating an implementation of an N-th stage of shift register unit in each gate driving sub-circuit shown in FIG. 9.

FIG. 10 is a schematic diagram illustrating a structure of an implementation of an N-th stage of shift register unit in the gate driving sub-circuit shown in FIG. 9. In some embodiments of the present disclosure, as shown in FIGS. 9 and 10, in an N-th stage of shift register unit in each gate driving sub-circuit, the input module 211 includes a first transistor M1 having a first electrode coupled to a signal input terminal INPUT, a second electrode coupled to a pull-up node PU, and a control electrode coupled to a first control terminal C1.

The reset module 212 includes a second transistor M2 having a first electrode coupled to a third power supply terminal W, a second electrode coupled to the pull-up node PU, and a control electrode coupled to a second control terminal C2.

The first output module 213 includes a capacitor C0, and a third transistor M3 having a first electrode coupled to a first clock signal terminal CLKE, a second electrode coupled to an output terminal OUT N, and a control electrode coupled to the pull-up node PU; a first terminal of the capacitor C0 is coupled to the pull-up node PU, and a second terminal of the capacitor C0 is coupled to the second electrode of the third transistor M3.

The second output module 213 includes a fourth transistor M4 having a first electrode coupled to a second clock signal terminal CLKDx, a second electrode coupled to an output terminal OUT (N+1), and a control electrode coupled to the pull-up node PU.

The timing of the signal provided by the second clock signal terminal CLKDx coupled to the N-th stage of shift register unit in each gate driving sub-circuit may be set according to actual needs, for example, according to the timing of the signals of the gate lines shown in FIGS. 5 and 6, which is not described in detail herein.

In addition, in the gate driving circuit shown in FIG. 9, for the related descriptions of the shift register units 21 except for the N-th stage of shift register unit 21 in each gate driving sub-circuit, reference may be made to the descriptions in the foregoing embodiments, and details are not repeated here.

Figure 11:
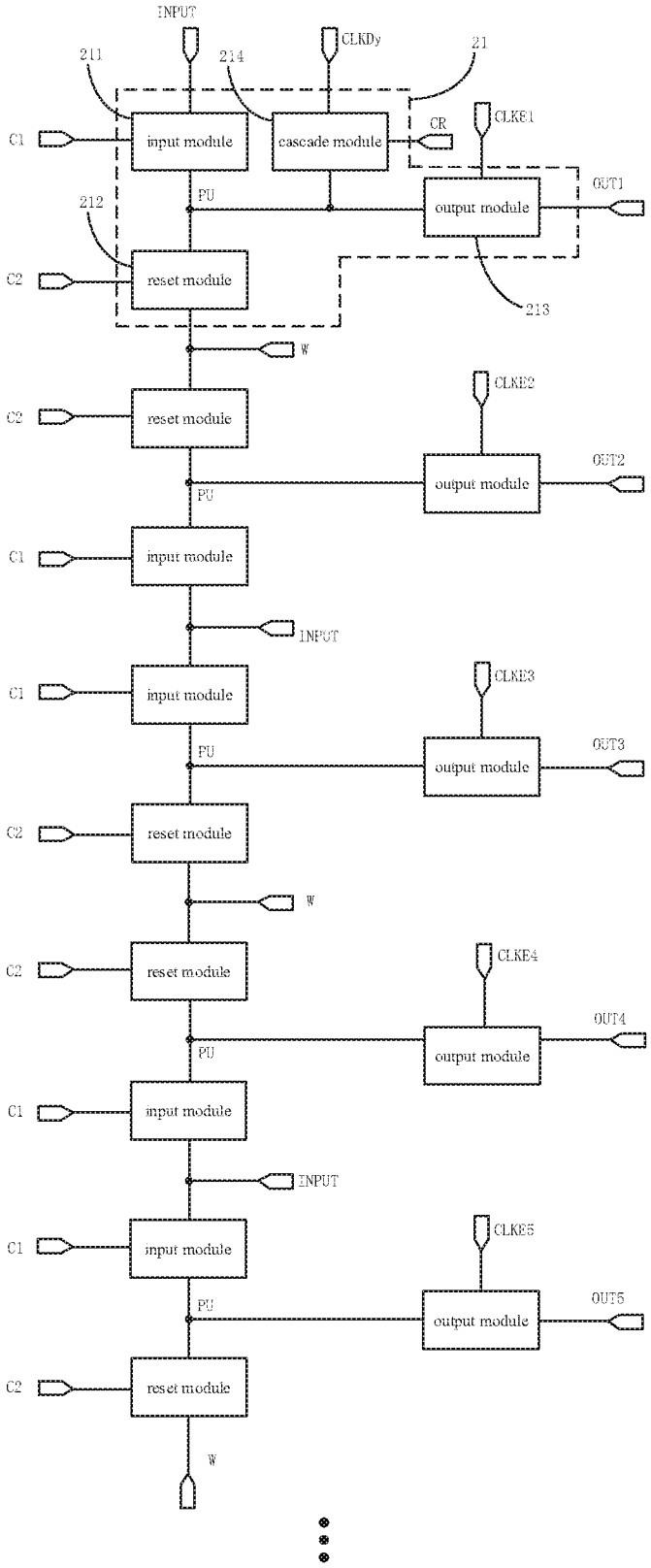
FIG. 11 is a diagram illustrating a structure of another gate driving circuit in the display panel shown in FIG. 1.

FIG. 11 is a schematic diagram illustrating a structure of another gate driving circuit in the display panel shown in FIG. 1. As shown in FIG. 11, the structure of the gate driving circuit is different from that of any of the foregoing embodiments in that: in some embodiments of the present disclosure, in each gate driving sub-circuit, a first stage of shift register unit 21 further includes a cascade module 214.

The cascade module 214 is coupled to a pull-up node PU, a third clock signal terminal CLKDy, and a carry signal terminal CR, and the cascade module 214 is configured to transmit a third clock signal provided by the third clock signal terminal CLKDy as a carry signal to the carry signal terminal CR in response to the control of the potential at the pull-up node PU.

In some embodiments of the present disclosure, as shown in FIG. 11, in the gate driving circuit 2, first control terminals C1 corresponding to first four gate driving sub-circuits are respectively coupled to the third external clock signal terminal, and the third external clock signal terminals may be configured to provide the clock signal as the carry signal to the first control terminals C1 corresponding to the first four gate driving sub-circuits; the first control terminal C1 corresponding to a k-th gate driving sub-circuit is coupled to the carry signal terminal CR corresponding to a first stage of shift register unit 21 in a (k−4)-th gate driving sub-circuit, where k is greater than or equal to 5 and less than or equal to a total number of the gate driving sub-circuits, and k is an integer.

In some embodiments of the present disclosure, as shown in FIG. 11, in the gate driving circuit 2, second control terminals C2 corresponding to the last four gate driving sub-circuits are respectively coupled to a fourth external clock signal terminal, which may be configured to provide a clock signal as a carry signal to the second control terminals C2 corresponding to the last four gate driving sub-circuits; the second control terminal C2 corresponding to a g-th gate driving sub-circuit is coupled to the carry signal terminal CR corresponding to a first stage of shift register unit 21 in a (g+4)-th gate driving sub-circuit, where g is greater than or equal to 1 and less than or equal to the total number of the gate driving sub-circuits minus four, and g is an integer.

Figure 12:
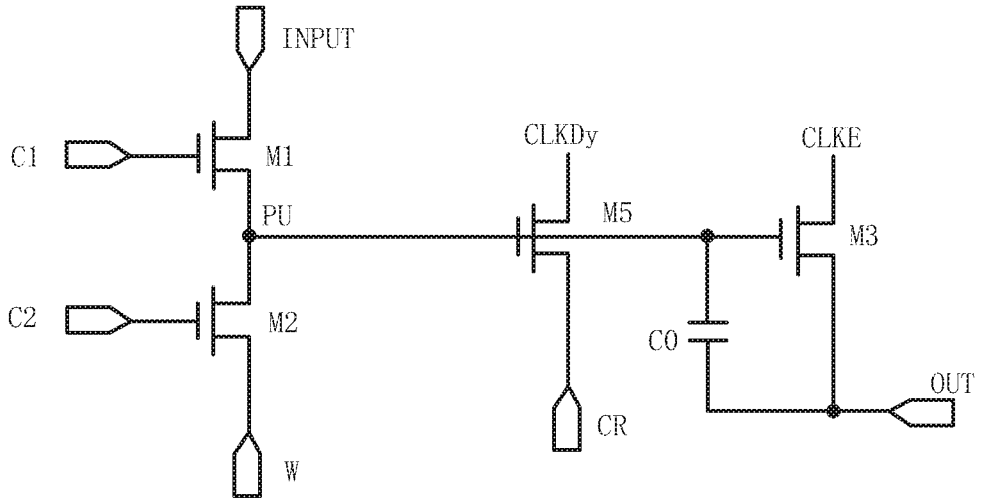
FIG. 12 is a schematic diagram illustrating a structure of an implementation of a first stage of shift register unit in each gate driving sub-circuit shown in FIG. 11.

FIG. 12 is a schematic diagram illustrating a structure of an implementation of a first stage of shift register unit in the gate driving sub-circuit shown in FIG. 11. In some embodiments of the present disclosure, as shown in FIGS. 11 and 12, in the first stage of shift register unit 21 in each gate driving sub-circuit, the input module 211 includes a first transistor M1 having a first electrode coupled to a signal input terminal INPUT, a second electrode coupled to a pull-up node PU, and a control electrode coupled to a first control terminal C1.

The reset module 212 includes a second transistor M2 having a first electrode coupled to a third power supply terminal W, a second electrode coupled to the pull-up node PU, and a control electrode coupled to a second control terminal C2.

The output module 213 includes a capacitor C0, and a third transistor M3 having a first electrode coupled to a first clock signal terminal CLKE, a second electrode coupled to an output terminal OUT, and a control electrode coupled to the pull-up node PU; a first terminal of the capacitor C0 is coupled to the pull-up node PU, and a second terminal of the capacitor C0 is coupled to the second electrode of the third transistor M3.

The cascade module 214 includes a fifth transistor M5 having a first electrode coupled to a third clock signal terminal CLKDy, a second electrode coupled to a carry signal terminal CR, and a control electrode coupled to the pull-up node PU.

In addition, in the gate driving circuit shown in FIG. 11, for the related descriptions of the shift register units 21 except for the first stage of shift register unit 21 in each gate driving sub-circuit, reference may be made to the descriptions in the foregoing embodiments, and details are not repeated here.

In some embodiments of the present disclosure, the gate driving circuit 2 is a GOA driving circuit.

It should be noted that, in practical applications, each shift register unit 21 may further include other suitable functional modules to implement the required functions. For example, each shift register unit 21 may further include any one or a combination of a pull-down module (not shown in the figures), an output reset module (not shown in the figures), and the like, where the pull-down module may be configured to implement a noise reduction function for the pull-up node PU and the output terminal OUT, and the output reset module may implement a reset function for the output terminal OUT.

An embodiment of the present disclosure further provides a method for driving a display panel. The display panel adopts the display panel provided by any of the above embodiments, and the method includes a display phase and a blanking phase for one frame. The driving method includes: in the display phase, the light emitting unit of each sub-pixel unit is driven by the pixel driving circuit of the sub-pixel unit to emit light; and in the blanking phase, a j-th row of sub-pixel units is randomly selected from all rows of sub-pixel units, and the pixel driving circuit in the j-th row of sub-pixel units is sensed through the sensing circuit in the j-th row of sub-pixel units.

Randomly selecting the j-th row of sub-pixel units from all rows of sub-pixel units refers to randomly selecting the j-th row of sub-pixel units from L rows of sub-pixel units of the display panel, where L is an integer greater than or equal to 2, and $1 \leq j \leq L$.

In some embodiments of the present disclosure, the display phase includes a data writing stage, a holding stage, and a light emitting stage. Referring to FIG. 2, the pixel driving circuit 12 includes a data writing circuit 121, a storage circuit 122, and a driving circuit 123.

In the data writing stage, a data signal provided by a corresponding data line is written into a first node through the data writing circuit; an initial signal provided by a sensing signal line is written into a second node through the sensing circuit.

In the holding stage, a signal of the first node is kept as the data signal and a signal of the second node is kept as the initial signal by the storage circuit.

In the light-emitting stage, a driving current is provided to the second node through the driving circuit to drive the light emitting unit to emit light.

It should be noted that, for the detailed description of the data writing stage, the holding stage and the light emitting stage, reference may be made to the descriptions of the stage A2, the stage A3 and the stage A4, which are not described in detail herein.

In some embodiments of the present disclosure, the blanking phase includes a restore stage, a charging stage, a sensing stage, a reset stage, and a data read-back stage. Referring to FIG. 2, the pixel driving circuit 12 includes a data writing circuit 121, a storage circuit 122, and a driving circuit 123.

In the restore stage, a data signal provided by a corresponding data line is written into a first node through the data writing circuit in a j-th row of sub-pixel units, and an initial signal provided by a sensing signal line is written into a second node through the sensing circuit in the j-th row of sub-pixel units.

In the charging stage, the sensing circuit is charged through the driving circuit in the j-th row of sub-pixel units.

In the sensing stage, a sensing voltage signal is sensed from the second node through the sensing circuit in the j-th row of sub-pixel units.

In the reset stage, an initial signal provided by the sensing signal line is written into the second node through the sensing circuit in the j-th row of sub-pixel units, so as to reset the second node.

In the data read-back stage, a data signal provided by the corresponding data line is written into the first node through the data writing circuit in the j-th row of sub-pixel units.

It should be noted that, for the detailed description of the restore stage, the charging stage, the sensing stage, the reset stage and the data read-back stage, reference may be made to the descriptions of the stages T1, T2, T3, T4, T5 and T6, which are not repeated herein.

In addition, an embodiment of the present disclosure further provides a display device, which includes the display panel provided in any of the above embodiments.

For the description of the display panel, reference may be made to the description of any one of the embodiments above, and details are not repeated herein.

It should be noted that, the display device in this embodiment may be any product or component with a display function, such as a display, an OLED panel, an OLED television, a mobile phone, a tablet computer, a notebook computer, a digital photo frame, a navigator and the like.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the present disclosure, and these changes and modifications are to be considered within the scope of the present disclosure.

What is claimed is:

1. A display panel, comprising a gate line group, a gate driving circuit, and a sub-pixel unit group, wherein the sub-pixel unit group comprises N rows of sub-pixel units, the gate line group comprises (N+1) gate lines, where N is an integer greater than or equal to 2;

the sub-pixel unit comprises a light emitting unit, a pixel driving circuit configured to drive the light emitting unit to emit light, and a sensing circuit configured to sense the pixel driving circuit;

the gate driving circuit comprises a plurality of output terminals, and is configured to sequentially output gate scanning signals through the plurality of output terminals, each gate line is coupled to one corresponding output terminal of the gate driving circuit; and in the sub-pixel unit group, the pixel driving circuit in a sub-pixel unit in an n-th row is coupled to an n-th gate line in the gate line group; and the sensing circuit in the sub-pixel unit in the n-th row is coupled to a (n+1)-th gate line in the gate line group, where $1 \leq n \leq N$, and n is an integer.

2. The display panel of claim 1, wherein the display panel comprises a plurality of gate lines and a plurality of rows of sub-pixel units, the plurality of gate lines are divided into a plurality of gate line groups, the plurality of rows of sub-pixel units are divided into a plurality of sub-pixel unit groups, and the plurality of gate line groups are in one-to-one correspondence with the plurality of sub-pixel unit groups.

3. The display panel of claim 2, wherein the display panel comprises a first sub-pixel unit group and a second sub-pixel unit group directly adjacent to each other, a first sub-pixel unit from the first sub-pixel unit group and a second sub-pixel unit from the second sub-pixel unit group are directly adjacent to each other, and the first sub-pixel unit and the second sub-pixel unit do not share a same gate line.

4. The display panel of claim 1, wherein the pixel driving circuit comprises a data writing circuit, a storage circuit and a driving circuit; the data writing circuit, the storage circuit, and the driving circuit are all coupled to a first node, and the driving circuit, the storage circuit, the sensing circuit and the light emitting unit are all coupled to a second node;

the data writing circuit is further coupled to a corresponding first gate line and a corresponding data line, and configured to receive a gate scanning signal provided by the corresponding first gate line and write a data signal provided by the corresponding data line into the first node in response to a control of the gate scanning signal provided by the corresponding first gate line;

the driving circuit is configured to, in response to a control of a signal in an active level state at the first node, output a driving current to the second node to drive the light emitting unit to emit light;

the sensing circuit is further coupled to a corresponding sensing signal line and a corresponding second gate line, and configured to receive a gate scanning signal provided by the corresponding second gate line, and in response to a control of the gate scanning signal provided by the corresponding second gate line, write an initial signal provided by the corresponding sensing signal line into the second node or provide a sensing voltage signal sensed from the second node to the corresponding sensing signal line; and the storage circuit is configured to store the data signal written into the first node and the initial signal written into the second node.

5. The display panel of claim 4, wherein the data writing circuit comprises a scan transistor having a first electrode coupled to the corresponding data line, a second electrode coupled to the first node, and a control electrode coupled to the corresponding first gate line.

6. The display panel of claim 5, wherein the driving circuit comprises a driving transistor having a first electrode coupled to a first power supply terminal, a second electrode coupled to the second node, and a control electrode coupled to the first node.

7. The display panel of claim 6, wherein the sensing circuit comprises a sensing transistor having a first electrode coupled to the corresponding sensing signal line, a second electrode coupled to the second node, and a control electrode coupled to the corresponding second gate line.

8. The display panel of claim 7, wherein the storage circuit comprises a storage capacitor having a first terminal coupled to the first node and a second terminal coupled to the second node.

9. The display panel of claim 4, wherein the sensing circuits in every m columns of sub-pixel units are coupled to one sensing signal line, where $m \geq 2$.

10. The display panel of claim 9, wherein the display panel further comprises an analog-to-digital conversion circuit and an initial signal source, each sensing signal line is coupled to the analog-to-digital conversion circuit through a first switch and coupled to the initial signal source through a second switch.

11. The display panel of claim 1, wherein the gate driving circuit comprises a gate driving sub-circuit comprising a plurality of cascaded shift register units, each of which has at least one output terminal, and each output terminal is coupled to one corresponding gate line in the gate line group, each of plurality of cascaded shift register units comprises an input circuit, a reset circuit and an output circuit, the input circuit is coupled to a signal input terminal, a first control terminal and a pull-up node, and is configured to write an input signal provided by the signal input terminal into the pull-up node in response to a control of a first control signal in an active level state provided by the first control terminal, the output circuit is coupled to the pull-up node, a first clock signal terminal, and a first output terminal, and is configured to transmit a first clock signal provided by the first clock signal terminal to the first output terminal in response to a control of a potential at the pull-up node, and the reset circuit is coupled to the pull-up node, a second control terminal and a second power supply terminal, and is configured to write a power supply signal provided by the second power supply terminal into the pull-up node in response to a control of a second control signal in an active level state provided by the second control terminal.

12. The display panel of claim 11, wherein the input circuit comprises a first transistor having a first electrode coupled to the signal input terminal, a second electrode coupled to the pull-up node, and a control electrode coupled to the first control terminal;

the reset circuit comprises a second transistor having a first electrode coupled to the second power supply terminal, a second electrode coupled to the pull-up node, and a control electrode coupled to the second control terminal; and the output circuit comprises a capacitor and a third transistor, a first electrode of the third transistor is coupled to the first clock signal terminal, a second electrode of the third transistor is coupled to the first output terminal, and a control electrode of the third transistor is coupled to the pull-up node; and a first terminal of the capacitor is coupled to the pull-up node, and a second terminal of the capacitor is coupled to the second electrode of the third transistor.

13. The display panel of claim 12, wherein the gate driving sub-circuit comprises (N+1) cascaded shift register units, each of which has a same circuit structure.

14. The display panel of claim 12, wherein the gate driving sub-circuit comprises N cascaded shift register units, the output circuit in an N-th stage of shift register unit is a first output circuit, and the N-th stage of shift register unit further comprises a second output circuit, the second output circuit is coupled to the pull-up node, a second clock signal terminal and a second output terminal, and is configured to transmit a second clock signal provided by the second clock signal terminal to the second output terminal in response to the control of the potential at the pull-up node.

15. The display panel of claim 14, wherein the second output circuit comprises a fourth transistor having a first electrode coupled to the second clock signal terminal, a second electrode coupled to the second output terminal, and a control electrode coupled to the pull-up node.

16. The display panel of claim 12, wherein a first stage of shift register unit in the gate driving sub-circuit further comprises a cascade circuit coupled to the pull-up node, a third clock signal terminal and a carry signal terminal and configured to transmit a third clock signal provided by the third clock signal terminal as a carry signal to the carry signal terminal in response to the control of the potential at the pull-up node, and the cascade circuit comprises a fifth transistor having a first electrode coupled to the third clock signal terminal, a second electrode coupled to the carry signal terminal, and a control electrode coupled to the pull-up node.

17. A display device, comprising the display panel of claim 1.

18. A method for driving a display panel, wherein the display panel is the display panel of claim 1, and the method comprises:

in a display phase of one frame, driving, by the pixel driving circuit of each sub-pixel unit, the light emitting unit of the sub-pixel unit to emit light; and in a blanking phase of one frame, randomly selecting a j-th row of sub-pixel units from all rows of sub-pixel units, and sensing the pixel driving circuit in the j-th row of sub-pixel units through the sensing circuit in the j-th row of sub-pixel units, where $1 \leq j \leq L$, j is an integer, and L is a number of the rows of sub-pixel units.

19. The method of claim 18, wherein the pixel driving circuit of the display panel comprises a data writing circuit, a storage circuit and a driving circuit, the data writing circuit, the storage circuit and the driving circuit are coupled to a first node, the driving circuit, the storage circuit, the sensing circuit and the light emitting unit are coupled to a second node, and the display phase comprises a data writing stage, a holding stage and a light-emitting stage;

in the data writing stage, a data signal provided by a corresponding data line is written into the first node through the data writing circuit; and an initial signal provided by a sensing signal line is written into the second node through the sensing circuit;

in the holding stage, a signal of the first node is kept as the data signal and a signal of the second node is kept as the initial signal by the capacitor circuit; and in the light-emitting stage, a driving current is provided to the second node through the driving circuit to drive the light emitting unit to emit light.

20. The method of claim 18, wherein the pixel driving circuit of the display panel comprises a data writing circuit, a storage circuit and a driving circuit, the data writing circuit, the storage circuit and the driving circuit are coupled to a first node, the driving circuit, the storage circuit, the sensing circuit and the light emitting unit are coupled to a second node, and the blanking phase comprises a restore stage, a charging stage, a sensing stage, a reset stage, and a data read-back stage;

in the restore stage, a data signal provided by a corresponding data line is written into the first node through the data writing circuit in the j-th row of sub-pixel units, and an initial signal provided by a sensing signal line is written into the second node through the sensing circuit in the j-th row of sub-pixel units;

in the charging stage, the sensing circuit is charged through the driving circuit in the j-th row of sub-pixel units;

in the sensing stage, a sensing voltage signal is sensed from the second node through the sensing circuit in the j-th row of sub-pixel units;

in the reset stage, the initial signal provided by the sensing signal line is written into the second node through the sensing circuit in the j-th row of sub-pixel units, so as to reset the second node; and in the data read-back stage, the data signal provided by the corresponding data line is written into the first node through the data writing circuit in the j-th row of sub-pixel units.

* * * * *